US007683922B2

(12) United States Patent
Nomura et al.

(10) Patent No.: US 7,683,922 B2
(45) Date of Patent: Mar. 23, 2010

(54) EXPOSURE HEAD AND AN IMAGE FORMING APPARATUS USING THE EXPOSURE HEAD

(75) Inventors: Yujiro Nomura, Shiojiri (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/203,774

(22) Filed: Sep. 3, 2008

(65) Prior Publication Data

US 2009/0060579 A1 Mar. 5, 2009

(30) Foreign Application Priority Data

Sep. 4, 2007 (JP) ..... 2007-228518
Jun. 12, 2008 (JP) ..... 2008-153934

(51) Int. Cl.
*B41J 15/14* (2006.01)
*B41J 27/00* (2006.01)

(52) U.S. Cl. ..... 347/241; 347/256

(58) Field of Classification Search ..... 347/236, 347/241, 230, 244, 256, 258; 359/558
See application file for complete search history.

(56) References Cited

U.S. PATENT DOCUMENTS 6,480,219 B1 * 11/2002 Uejima et al. ..... 347/241
7,095,560 B2 * 8/2006 Toyoda et al. ..... 359/558
2005/0093963 A1 * 5/2005 Masuda ..... 347/236

FOREIGN PATENT DOCUMENTS

JP 2000-158705 6/2000

* cited by examiner

*Primary Examiner*—Hai C Pham
(74) *Attorney, Agent, or Firm*—Hogan & Hartson LLP

(57) ABSTRACT

An exposure head, includes: a first imaging optical system and a second imaging optical system which are arranged in a first direction; a light emitting element which emits light to be imaged by the first imaging optical system; and a light emitting element which emits light to be imaged by the second imaging optical system, wherein an inter-optical-system distance in the first direction between the first imaging optical system and the second imaging optical system satisfies the following expression:

$$m1 \cdot L1 + m2 \cdot L2 > 2P1 - (m1 \cdot dp1 + m2 \cdot dp2)$$

where m1 represents an absolute value of the optical magnification of the first imaging optical system, L1 represents a width in the first direction of the light emitting element to be imaged by the first imaging optical system, dp1 represents a pitch between the light emitting element in the first direction in the light emitting element to be imaged by the first imaging optical system, m2 represents an absolute value of the optical magnification of the second imaging optical system, L2 represents a width in the first direction of the light emitting element to be imaged by the second imaging optical system, and dp2 represents a pitch between the light emitting element in the first direction in the light emitting element to be imaged by the second imaging optical system.

14 Claims, 22 Drawing Sheets

FIG. 15A : IN CASE WHERE DISPLACEMENTS OF LENSES ARE NOT OCCURRED
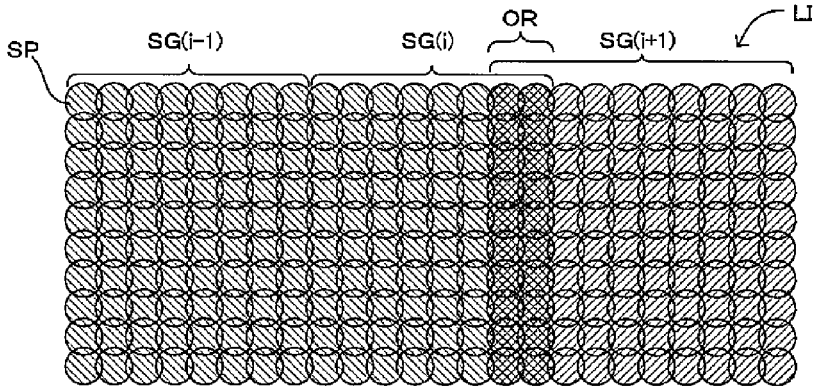
FIG. 15B : IN CASE WHERE DISPLACEMENTS OF LENSES ARE OCCURRED
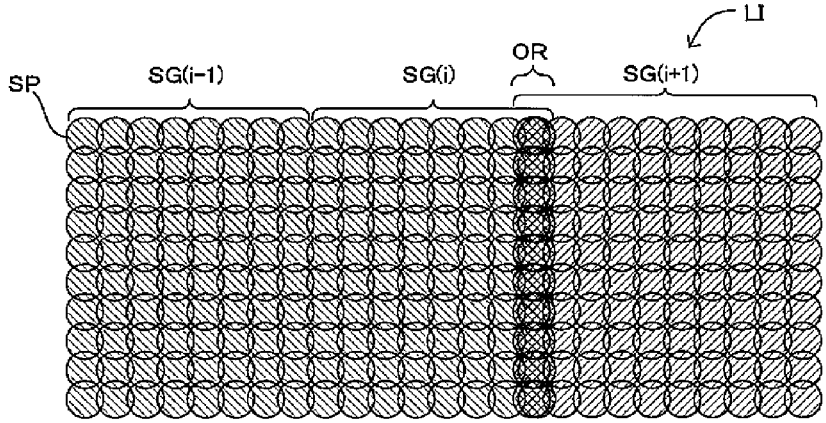
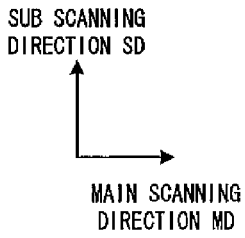

FIG. 21

| SURFACE NUMBER | rm [mm] (CENTER CURVATURE RADIUS IN SECTION OF MAIN SCANNING DIRECTION) | d [mm] (SURFACE INTERVAL) | nd (REFRACTIVE INDEX) λ =690 [nm] | K,A,B,C,D,E,F,G,H,I (ASPHERICAL COEFFICIENT) c (CURVATURE ON OPTICAL AXIS) |
|---|---|---|---|---|
| S1 (OBJECT PLANE) | rm1= ∞ | d1= 0.55 | nd1= 1.499857 | |
| S2 (EMERGENT SURFACE OF GLASS BASE MATERIAL ) | rm2= ∞ | d2= 4.1692 | | |
| S3 (APERTURE) | rm3= ∞ | d3= 0.04 | | |
| S4 (x-y POLYNOMIAL SURFACE) | rm4= 1.4847475 | d4= 0.34 | nd4= 1.504488 | c4=1/1.4847475<br>K4=-0.4695069<br>A4=0.0<br>B4=0.0009838021<br>C4=-0.01733771<br>D4=-0.03486049<br>E4=-0.02161239<br>F4=-0.004865624<br>G4=-0.01474670<br>H4=-0.006309772<br>I4=-0.001046989 |
| S5 (GLASS BASE MATERIAL) | rm5= ∞ | d5= 0.8 | nd5= 1.536988 | |
| S6 | rm6= ∞ | d6= 1.3942 | | |
| S7 (x-y POLYNOMIAL SURFACE) | rm7= 1.2180147 | d7= 0.37 | nd7= 1.504488 | c7=1/1.2180147<br>K7=-1.0<br>A7=0.0<br>B7=-0.004273950<br>C7=-0.001337582<br>D7=-0.01558535<br>E7=0.003768732<br>F7=-0.03211906<br>G7=-0.08882339<br>H7=-0.1095676<br>I7=-0.03408306 |
| S8 (GLASS BASE MATERIAL) | rm8= ∞ | d8= 0.8 | nd8= 1.536988 | |
| S9 | rm9= ∞ | d9= 0.9598 | | |
| S10 (IMAGE PLANE) | rm10= ∞ | | | |

NON-ROTATIONALLY-SYMMETRICAL ASPHERICAL SURFACE
(x-y POLYNOMIAL SURFACE) DEFINITIONAL EQUATION···

$$\frac{cr^2}{1+\sqrt{1-(1+K)c^2r^2}} + Ax^2 + By^2 + Cx^4 + Dx^2y^2 + Ey^4 + Fx^6 + Gx^4y^2 + Hx^2y^4 + Iy^6$$

$$r^2 = x^2 + y^2$$

x···MAIN SCANNING DIRECTION COORDINATE
y···SUB SCANNING DIRECTION COORDINATE
c···CURVATURE ON OPTICAL AXIS
K···CONIC CONSTANT
A, B, C, D, E, F, G, H, I···ASPHERICAL COEFFICIENT

CROSS SECTION ALONG MAIN SCANNING DIRECTION

CROSS SECTION ALONG SUB SCANNING DIRECTION

FIG. 24

SIMULATION CONDITION

| | |
|---|---|
| WAVELENGTH | 690[nm] |
| NUMERICAL APERTURE ON IMAGE SIDE | 0.29960 |
| LATERAL MAGNIFICATION | −0.504 |

FIG. 25

VARIOUS VALUES

| | |
|---|---|
| $P_{(i)}$ [mm] | 0.593 |
| $m_{(i)}$ | 0.504 |
| $m_{(i+1)}$ | 0.504 |
| $L_{(i)}$ [mm] | 1.239 |
| $L_{(i+1)}$ [mm] | 1.225 |
| $dp_{(i)}$ [mm] | 0.021 |
| $dp_{(i+1)}$[mm] | 0.021 |

EXPOSURE HEAD AND AN IMAGE FORMING APPARATUS USING THE EXPOSURE HEAD

CROSS REFERENCE TO RELATED APPLICATION

The disclosure of Japanese Patent Applications No. 2007-228518 filed on Sep. 4, 2007 and No. 2008-153934 filed on Jun. 12, 2008 including specification, drawings and claims is incorporated herein by reference in its entirety.

BACKGROUND

1. Technical Field

The invention relates to an exposure head including a plurality of light emitting elements and adapted to focus light beams emitted from the respective light emitting elements on an image plane and an image forming apparatus using the exposure head.

2. Related Art

An exposure head using a light emitting element array, for example, as disclosed in JP-A-2000-158705 has been proposed as an exposure head of this type. In this light emitting element array, a plurality of light emitting elements are linearly arrayed at constant pitches in the longitudinal direction corresponding to a main scanning direction. Further, a plurality of thus constructed light emitting element arrays are provided and lenses are arranged in one-to-one correspondence with the respective light emitting element arrays. In each light emitting element array, light beams are emitted from the plurality of light emitting elements belonging to this array, and the emitted light beams are focused on an image plane by the lens arranged in conformity with this array. In this way, spots are formed in a line in the main scanning direction on the image plane.

SUMMARY

By the way, multiple light emitting elements belonging to each light emitting element array form a group of spots on an image plane, thereby a spot group is formed. These spot groups form an image on the image plane. It then follows that for a better image quality, it is very important to form a plurality of spot groups such that the locations of the spot groups are in a predetermined relationship to each other. Despite this, in some instances, spot groups which are adjacent to each other in a main scanning direction get deviated from each other due to various factors, resulting in formation of gaps between these spot groups. To be noted particularly is that an image forming apparatus, when forming a latent image on a photosensitive member using an exposure head which has such a problem and thereafter developing the latent image to thereby form a toner image, forms vertical stripes in the toner image, which is a deteriorated image quality.

An advantage of some aspects of the invention is to provide a technique capable of realizing satisfactory spot formation in an exposure head and an image forming apparatus using a plurality of light emitting elements.

According to a first aspect of the invention, there is provided an exposure head, comprising: a first imaging optical system and a second imaging optical system which are arranged in a first direction; a light emitting element which emits light to be imaged by the first imaging optical system; and a light emitting element which emits light to be imaged by the second imaging optical system, wherein an inter-optical-system distance in the first direction between the first imaging optical system and the second imaging optical system satisfies the following expression:

$$m1 \cdot L1 + m2 \cdot L2 > 2P1 - (m1 \cdot dp1 + m2 \cdot dp2)$$

where m1 represents an absolute value of the optical magnification of the first imaging optical system, L1 represents a width in the first direction of the light emitting element to be imaged by the first imaging optical system, dp1 represents a pitch between the light emitting element in the first direction in the light emitting element to be imaged by the first imaging optical system, m2 represents an absolute value of the optical magnification of the second imaging optical system, L2 represents a width in the first direction of the light emitting element to be imaged by the second imaging optical system, and dp2 represents a pitch between the light emitting element in the first direction in the light emitting element to be imaged by the second imaging optical system.

According to a second aspect of the invention, there is provided an image forming apparatus, comprising: a latent image carrier; and an exposure head that forms a latent image on the latent image carrier, wherein the exposure head includes: a first imaging optical system and a second imaging optical system which are arranged in a first direction; a light emitting element which emits light to be imaged by the first imaging optical system; and a light emitting element which emits light to be imaged by the second imaging optical system, and wherein an inter-optical-system distance in the first direction between the first imaging optical system and the second imaging optical system satisfies the following expression:

$$m1 \cdot L1 + m2 \cdot L2 > 2P1 - (m1 \cdot dp1 + m2 \cdot dp2)$$

where m1 represents an absolute value of the optical magnification of the first imaging optical system, L1 represents a width in the first direction of the light emitting element to be imaged by the first imaging optical system, dp1 represents a pitch between the light emitting element in the first direction in the light emitting element to be imaged by the first imaging optical system, m2 represents an absolute value of the optical magnification of the second imaging optical system, L2 represents a width in the first direction of the light emitting element to be imaged by the second imaging optical system, and dp2 represents a pitch between the light emitting element in the first direction in the light emitting element to be imaged by the second imaging optical system.

According to a third aspect of the invention, there is provided an exposure head, comprising: an i-th imaging optical system and an (i+1)-th imaging optical system which are arranged in a first direction, where i is a positive integer; a light emitting element which emits light to be imaged by the i-th imaging optical system; and a light emitting element which emits light to be imaged by the (i+1)-th imaging optical system, wherein an inter-optical-system distance in the first direction between the i-th imaging optical system and the (i+1)-th imaging optical system satisfies the following expression:

$$m(i) \cdot L(i) + m(i+1) \cdot L(i+1) > 2P(i) - (m(i) \cdot dp(i) + m(i+1) \cdot dp(i+1))$$

where m(i) represents an absolute value of the optical magnification of the i-th imaging optical system, L(i) represents a width in the first direction of the light emitting element to be imaged by the i-th imaging optical system, dp(i) represents a pitch between the light emitting element in the first direction in the light emitting element to be imaged by the i-th imaging optical system, m(i+1) represents an absolute value of the optical magnification of the (i+1)-th imaging optical system, L(i+1) represents a width in the first direction of the light emitting element to be imaged by the (i+1)-th imaging optical system, and dp(i+1) represents a pitch between the light emitting element in the first direction in the light emitting element to be imaged by the (i+1)-th imaging optical system.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIGS. 15A and 15B are diagrams showing the overlapping spot region.

FIG. 21 shows data of an optical system in the example.

FIG. 24 shows conditions used in a simulation to calculate the optical paths shown in FIGS. 22 and 23.

FIG. 25 shows examples of various values in the case where the invention is applied to the line head 29 which has the imaging optical system shown in FIGS. 21 to 24.

DESCRIPTION OF EXEMPLARY EMBODIMENTS

A. Description of Terminology

Before describing embodiments of the invention, terminology used in this specification is described.

Figure 1:
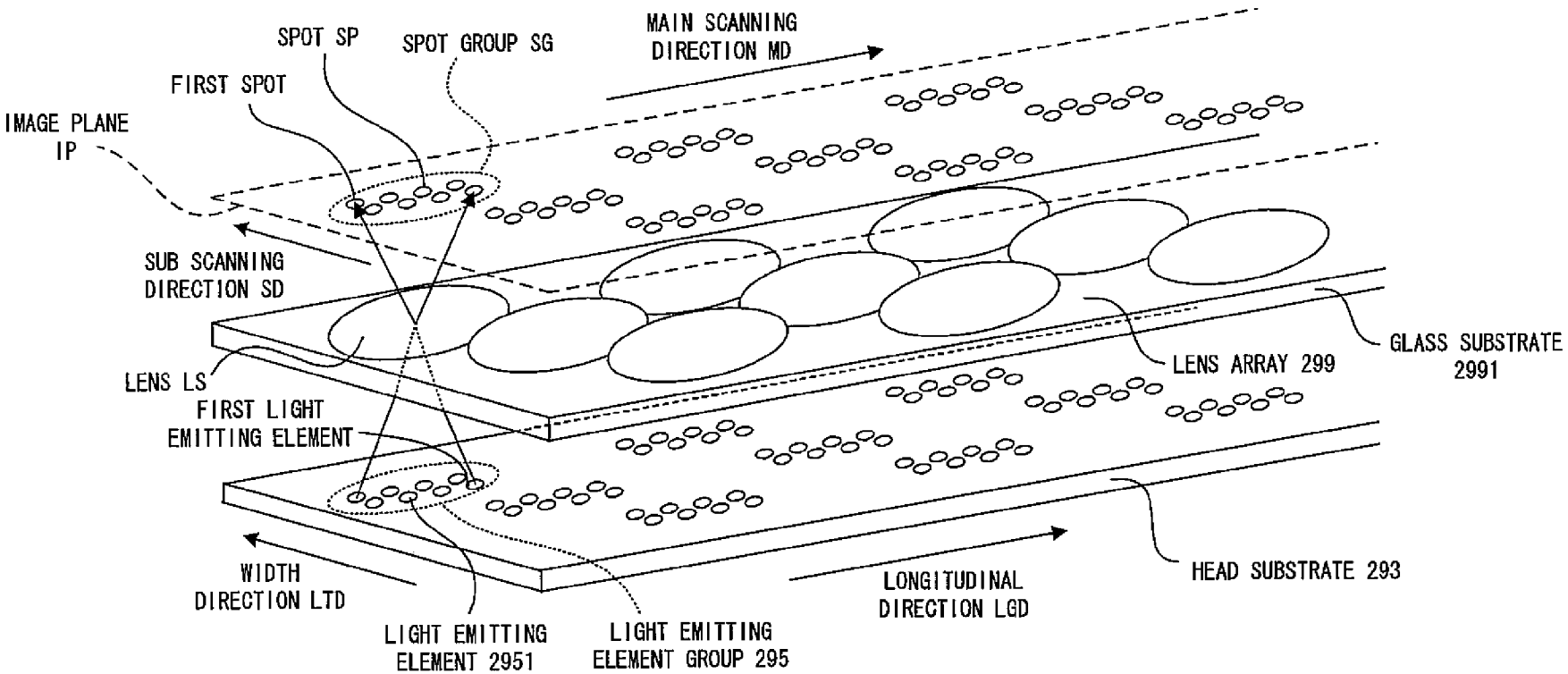
FIGS. 1 and 2 are diagrams showing terminology used in this specification.
Figure 2:
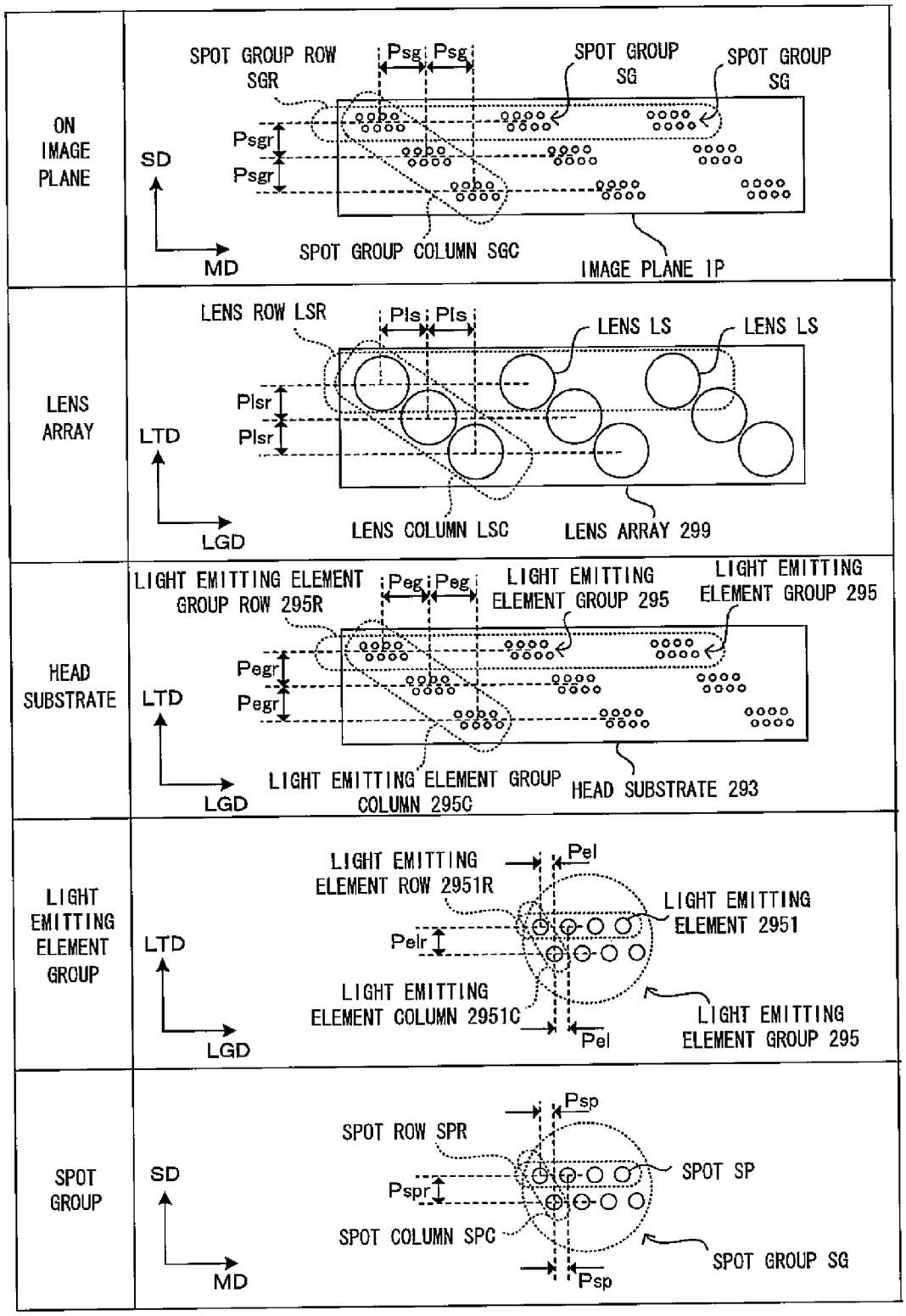

FIGS. 1 and 2 are diagrams showing terminology used in this specification. Here, terminology used in this specification is organized with reference to FIGS. 1 and 2. In this specification, a conveying direction of a surface (image plane IP) of a photosensitive drum 21 is defined to be a sub scanning direction SD and a direction normal to or substantially normal to the sub scanning direction SD is defined to be a main scanning direction MD. Further, a line head 29 is arranged relative to the surface (image plane IP) of the photosensitive drum 21 such that its longitudinal direction LGD corresponds to the main scanning direction MD and its width direction LTD corresponds to the sub scanning direction SD.

Collections of a plurality of (eight in FIGS. 1 and 2) light emitting elements 2951 arranged on a head substrate 293 in one-to-one correspondence with a plurality of lenses LS of a lens array 299 are defined to be light emitting element groups 295. In other words, in the head substrate 293, the light emitting element groups 295 each including the plurality of light emitting elements 2951 are arranged in conformity with the respective lenses LS. Further, collections of a plurality of spots SP formed on the image plane IP by focusing light beams from the light emitting element groups 295 toward the image plane IP by the lenses LS corresponding to the light emitting element groups 295 are defined to be spot groups SG. In other words, a plurality of spot groups SG can be formed in one-to-one correspondence with the plurality of light emitting element groups 295. In each spot group SG, the most upstream spot in the main scanning direction MD and the sub scanning direction SD is particularly defined to be a first spot. The light emitting element 2951 corresponding to the first spot is particularly defined to be a first light emitting element.

FIGS. 1 and 2 show a case where the spots SP are formed with the image plane kept stationary in order to facilitate the understanding of the correspondence relationship of the light emitting element groups 295, the lenses LS and the spot groups SG. Accordingly, the formation positions of the spots SP in the spot groups SG are substantially similar to the arranged positions of the light emitting elements 2951 in the light emitting element groups 295. However, as described later, an actual spot forming operation is performed while the image plane IP (surface of the photosensitive drum 21) is conveyed in the sub scanning direction SD. As a result, the spots SP formed by the plurality of light emitting elements 2951 of the head substrate 293 are formed on a straight line substantially parallel to the main scanning direction MD.

Further, spot group rows SGR and spot group columns SGC are defined as shown in the column "On Image Plane" of FIG. 2. Specifically, a plurality of spot groups SG aligned in the main scanning direction MD is defined to be the spot group row SGR. A plurality of spot group rows SGR are arranged at specified spot group row pitches Psgr in the sub scanning direction SD. Further, a plurality of (three in FIG. 2) spot groups SG arranged at the spot group row pitches Psgr in the sub scanning direction SD and at spot group pitches Psg in the main scanning direction MD are defined to be the spot group column SGC. It should be noted that the spot group row pitch Psgr is a distance in the sub scanning direction SD between the geometric centers of gravity of the two spot group rows SGR adjacent in the sub scanning direction SD and that the spot group pitch Psg is a distance in the main scanning direction MD between the geometric centers of gravity of the two spot groups SG adjacent in the main scanning direction MD.

Lens rows LSR and lens columns LSC are defined as shown in the column of "Lens Array" of FIG. 2. Specifically, a plurality of lenses LS aligned in the longitudinal direction LGD is defined to be the lens row LSR. A plurality of lens rows LSR are arranged at specified lens row pitches Plsr in the width direction LTD. Further, a plurality of (three in FIG. 2) lenses LS arranged at the lens row pitches Plsr in the width direction LTD and at lens pitches Pls in the longitudinal direction LGD are defined to be the lens column LSC. It should be noted that the lens row pitch Plsr is a distance in the width direction LTD between the geometric centers of gravity of the two lens rows LSR adjacent in the width direction LTD and that the lens pitch Pls is a distance in the longitudinal direction LGD between the geometric centers of gravity of the two lenses LS adjacent in the longitudinal direction LGD.

Light emitting element group rows 295R and light emitting element group columns 295C are defined as in the column "Head Substrate" of FIG. 2. Specifically, a plurality of light emitting element groups 295 aligned in the longitudinal direction LGD is defined to be the light emitting element group row 295R. A plurality of light emitting element group rows 295R are arranged at specified light emitting element group row pitches Pegr in the width direction LTD. Further, a plurality of (three in FIG. 2) light emitting element groups 295 arranged at the light emitting element group row pitches Pegr in the width direction LTD and at light emitting element group pitches Peg in the longitudinal direction LGD are defined to be the light emitting element group column 295C. It should be noted that the light emitting element group row pitch Pegr is a distance in the width direction LTD between the geometric centers of gravity of the two light emitting element group rows 295R adjacent in the width direction LTD and that the light emitting element group pitch Peg is a distance in the longitudinal direction LGD between the geometric centers of gravity of the two light emitting element groups 295 adjacent in the longitudinal direction LGD.

Light emitting element rows 2951R and light emitting element columns 2951C are defined as in the column "Light emitting element Group" of FIG. 2. Specifically, in each light emitting element group 295, a plurality of light emitting elements 2951 aligned in the longitudinal direction LGD is defined to be the light emitting element row 2951R. A plurality of light emitting element rows 2951R are arranged at specified light emitting element row pitches Pelr in the width direction LTD. Further, a plurality of (two in FIG. 2) light emitting elements 2951 arranged at the light emitting element row pitches Pelr in the width direction LTD and at light emitting element pitches Pel in the longitudinal direction LGD are defined to be the light emitting element column 2951C. It should be noted that the light emitting element row pitch Pelr is a distance in the width direction LTD between the geometric centers of gravity of the two light emitting element rows 2951R adjacent in the width direction LTD and that the light emitting element pitch Pel is a distance in the longitudinal direction LGD between the geometric centers of gravity of the two light emitting elements 2951 adjacent in the longitudinal direction LGD.

Spot rows SPR and spot columns SPC are defined as shown in the column "Spot Group" of FIG. 2. Specifically, in each spot group SG, a plurality of spots SP aligned in the longitudinal direction LGD is defined to be the spot row SPR. A plurality of spot rows SPR are arranged at specified spot row pitches Pspr in the width direction LTD. Further, a plurality of (two in FIG. 2) spots arranged at the spot row pitches Pspr in the width direction LTD and at spot pitches Psp in the longitudinal direction LGD are defined to be the spot column SPC. It should be noted that the spot row pitch Pspr is a distance in the sub scanning direction SD between the geometric centers of gravity of the two spot rows SPR adjacent in the sub scanning direction and that the spot pitch Psp is a distance in the main scanning direction MD between the geometric centers of gravity of the two spots SP adjacent in the main scanning direction MD.

B. Embodiment

Figure 3:
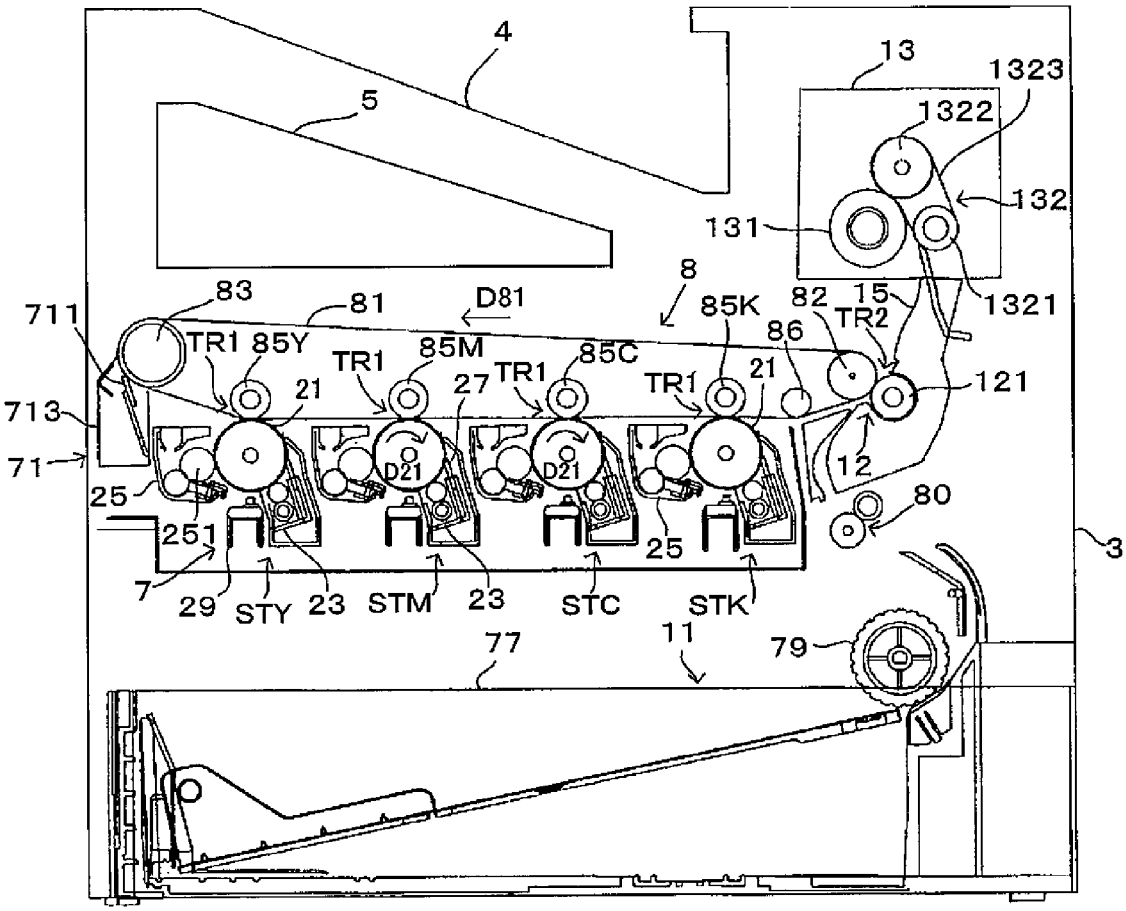
FIG. 3 is a diagram showing an embodiment of an image forming apparatus according to the invention.
Figure 4:
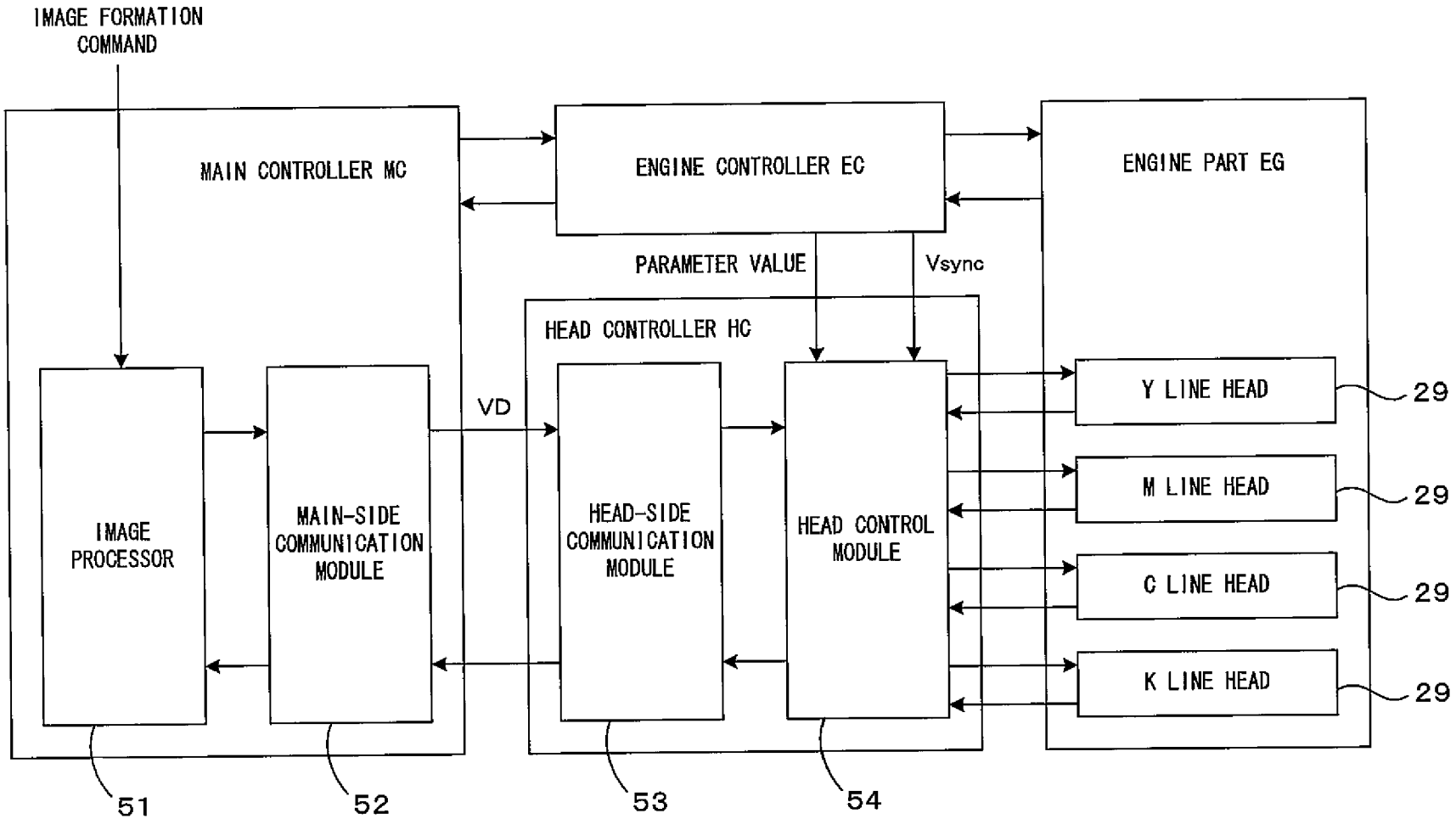
FIG. 4 is a diagram showing the electrical construction of the image forming apparatus of FIG. 3.

FIG. 3 is a diagram showing an embodiment of an image forming apparatus according to the invention, and FIG. 4 is a diagram showing the electrical construction of the image forming apparatus of FIG. 3. This apparatus is an image forming apparatus that can selectively execute a color mode for forming a color image by superimposing four color toners of black (K), cyan (C), magenta (M) and yellow (Y) and a monochromatic mode for forming a monochromatic image using only black (K) toner FIG. 3 is a diagram corresponding to the execution of the color mode. In this image forming apparatus, when an image formation command is given from an external apparatus such as a host computer to a main controller MC having a CPU and memories, the main controller MC feeds a control signal and the like to an engine controller EC and feeds video data VD corresponding to the image formation command to a head controller HC. This head controller HC controls line heads 29 of the respective colors based on the video data VD from the main controller MC, a vertical synchronization signal Vsync from the engine controller EC and parameter values from the engine controller EC. In this way, an engine part EG performs a specified image forming operation to form an image corresponding to the image formation command on a sheet such as a copy sheet, transfer sheet, form sheet or transparent sheet for OHP.

An electrical component box 5 having a power supply circuit board, the main controller MC, the engine controller EC and the head controller HC built therein is disposed in a housing main body 3 of the image forming apparatus according to this embodiment. An image forming unit 7, a transfer belt unit 8 and a sheet feeding unit 11 are also arranged in the housing main body 3. A secondary transfer unit 12, a fixing unit 13, and a sheet guiding member 15 are arranged at the right side in the housing main body 3 in FIG. 3. It should be noted that the sheet feeding unit 11 is detachably mountable into the housing main body 3. The sheet feeding unit 11 and the transfer belt unit 8 are so constructed as to be detachable for repair or exchange respectively.

The image forming unit 7 includes four image forming stations STY (for yellow), STM (for magenta), STC (for cyan) and STK (for black) which form a plurality of images having different colors. Each of the image forming stations STY, STM, STC and STK includes a photosensitive drum 21 on the surface of which a toner image of the corresponding color is to be formed. Each photosensitive drum 21 is connected to its own driving motor and is driven to rotate at a specified speed in a direction of arrow D21 in FIG. 3, whereby the surface of the photosensitive drum 21 is transported in a sub scanning direction SD. Further, a charger 23, the line head 29, a developer 25 and a photosensitive drum cleaner 27 are arranged in a rotating direction D21 around each photosensitive drum 21. A charging operation, a latent image forming operation and a toner developing operation are performed by these functional sections. Accordingly, a color image is formed by superimposing toner images formed by all the image forming stations STY, STM, STC and STK on a transfer belt 81 of the transfer belt unit 8 at the time of executing the color mode, and a monochromatic image is formed using only a toner image formed by the image forming station STK at the time of executing the monochromatic mode. Meanwhile, since the respective image forming stations of the image forming unit 7 are identically constructed, reference characters are given to only some of the image forming stations while being not given to the other image forming stations in order to facilitate the diagrammatic representation in FIG. 3.

The charger 23 includes a charging roller having the surface thereof made of an elastic rubber. This charging roller is constructed to be rotated by being held in contact with the surface of the photosensitive drum 21 at a charging position. As the photosensitive drum 21 rotates, the charging roller is rotated at the same circumferential speed in a direction driven by the photosensitive drum 21. This charging roller is connected to a charging bias generator (not shown) and charges the surface of the photosensitive drum 21 at the charging position where the charger 23 and the photosensitive drum 21 are in contact upon receiving the supply of a charging bias from the charging bias generator.

Each line head 29 includes a plurality of light emitting elements arrayed in the axial direction of the photosensitive drum 21 (direction normal to the plane of FIG. 3) and is positioned separated from the photosensitive drum 21. Light beams are emitted from these light emitting elements to the surface of the photosensitive drum 21 charged by the charger 23, thereby forming a latent image on this surface. In this embodiment, the head controller HC is provided to control the line heads 29 of the respective colors, and controls the respective line heads 29 based on the video data VD from the main controller MC and a signal from the engine controller EC. Specifically, in this embodiment, image data included in an image formation command is inputted to an image processor 51 of the main controller MC. Then, video data VD of the respective colors are generated by applying various image processings to the image data, and the video data VD are fed to the head controller HC via a main-side communication module 52. In the head controller HC, the video data VD are fed to a head control module 54 via a head-side communication module 53. Signals representing parameter values relating to the formation of a latent image and the vertical synchronization signal Vsync are fed to this head control module 54 from the engine controller EC as described above. Based on these signals, the video data VD and the like, the head controller HC generates signals for controlling the driving of the elements of the line heads 29 of the respective colors and outputs them to the respective line heads 29. In this way, the operations of the light emitting elements in the respective line heads 29 are suitably controlled to form latent images corresponding to the image formation command.

In this embodiment, the photosensitive drum 21, the charger 23, the developer 25 and the photosensitive drum cleaner 27 of each of the image forming stations STY, STM, STC and STK are unitized as a photosensitive cartridge. Further, each photosensitive cartridge includes a nonvolatile memory for storing information on the photosensitive cartridge. Wireless communication is performed between the engine controller EC and the respective photosensitive cartridges. By doing so, the information on the respective photosensitive cartridges is transmitted to the engine controller EC and information in the respective memories can be updated and stored.

The developer 25 includes a developing roller 251 carrying toner on the surface thereof. By a development bias applied to the developing roller 251 from a development bias generator (not shown) electrically connected to the developing roller 251, charged toner is transferred from the developing roller 251 to the photosensitive drum 21 to develop the latent image formed by the line head 29 at a development position where the developing roller 251 and the photosensitive drum 21 are in contact.

The toner image developed at the development position in this way is primarily transferred to the transfer belt 81 at a primary transfer position TR1 to be described later where the transfer belt 81 and each photosensitive drum 21 are in contact after being transported in the rotating direction D21 of the photosensitive drum 21.

Further, in this embodiment, the photosensitive drum cleaner 27 is disposed in contact with the surface of the photosensitive drum 21 downstream of the primary transfer position TR1 and upstream of the charger 23 with respect to the rotating direction D21 of the photosensitive drum 21. This photosensitive drum cleaner 27 removes the toner remaining on the surface of the photosensitive drum 21 to clean after the primary transfer by being held in contact with the surface of the photosensitive drum.

The transfer belt unit 8 includes a driving roller 82, a driven roller (blade facing roller) 83 arranged to the left of the driving roller 82 in FIG. 3, and the transfer belt 81 mounted on these rollers and driven to turn in a direction of arrow D81 in FIG. 3 (conveying direction). The transfer belt unit 8 also includes four primary transfer rollers 85Y, 85M, 85C and 85K arranged to face in a one-to-one relationship with the photosensitive drums 21 of the respective image forming stations STY, STM, STC and STK inside the transfer belt 81 when the photosensitive cartridges are mounted. These primary transfer rollers 85Y, 85M, 85C and 85K are respectively electrically connected to a primary transfer bias generator (not shown). As described in detail later, at the time of executing the color mode, all the primary transfer rollers 85Y, 85M, 85C and 85K are positioned on the sides of the image forming stations STY, STM, STC and STK as shown in FIG. 3, whereby the transfer belt 81 is pressed into contact with the photosensitive drums 21 of the image forming stations STY, STM, STC and STK to form the primary transfer positions TR1 between the respective photosensitive drums 21 and the transfer belt 81. By applying primary transfer biases from the primary transfer bias generator to the primary transfer rollers 85Y, 85M, 85C and 85K at suitable timings, the toner images formed on the surfaces of the respective photosensitive drums 21 are transferred to the surface of the transfer belt 81 at the corresponding primary transfer positions TR1 to form a color image.

On the other hand, out of the four primary transfer rollers 85Y, 85M, 85C and 85K, the color primary transfer rollers 85Y, 85M, 85C are separated from the facing image forming stations STY, STM and STC and only the monochromatic primary transfer roller 85K is brought into contact with the image forming station STK at the time of executing the monochromatic mode, whereby only the monochromatic image forming station STK is brought into contact with the transfer belt 81. As a result, the primary transfer position TR1 is formed only between the monochromatic primary transfer roller 85K and the image forming station STK. By applying a primary transfer bias at a suitable timing from the primary transfer bias generator to the monochromatic primary transfer roller 85K, the toner image formed on the surface of the photosensitive drum 21 is transferred to the surface of the transfer belt 81 at the primary transfer position TR1 to form a monochromatic image.

The transfer belt unit 8 further includes a downstream guide roller 86 disposed downstream of the monochromatic primary transfer roller 85K and upstream of the driving roller 82. This downstream guide roller 86 is so disposed as to come into contact with the transfer belt 81 on an internal common tangent to the primary transfer roller 85K and the photosensitive drum 21 at the primary transfer position TR1 formed by the contact of the monochromatic primary transfer roller 85K with the photosensitive drum 21 of the image forming station STK.

The driving roller 82 drives to rotate the transfer belt 81 in the direction of the arrow D81 and doubles as a backup roller for a secondary transfer roller 121. A rubber layer having a thickness of about 3 mm and a volume resistivity of 1000 kΩ·cm or lower is formed on the circumferential surface of the driving roller 82 and is grounded via a metal shaft, thereby serving as an electrical conductive path for a secondary transfer bias to be supplied from an unillustrated secondary transfer bias generator via the secondary transfer roller 121. By providing the driving roller 82 with the rubber layer having high friction and shock absorption, an impact caused upon the entrance of a sheet into a contact part (secondary transfer position TR2) of the driving roller 82 and the secondary transfer roller 121 is unlikely to be transmitted to the transfer belt 81 and image deterioration can be prevented.

The sheet feeding unit 11 includes a sheet feeding section which has a sheet cassette 77 capable of holding a stack of sheets, and a pickup roller 79 which feeds the sheets one by one from the sheet cassette 77. The sheet fed from the sheet feeding section by the pickup roller 79 is fed to the secondary transfer position TR2 along the sheet guiding member 15 after having a sheet feed timing adjusted by a pair of registration rollers 80.

The secondary transfer roller 121 is provided freely to abut on and move away from the transfer belt 81, and is driven to abut on and move away from the transfer belt 81 by a secondary transfer roller driving mechanism (not shown). The fixing unit 13 includes a heating roller 131 which is freely rotatable and has a heating element such as a halogen heater built therein, and a pressing section 132 which presses this heating roller 131. The sheet having an image secondarily transferred to the front side thereof is guided by the sheet guiding member 15 to a nip portion formed between the heating roller 131 and a pressure belt 1323 of the pressing section 132, and the image is thermally fixed at a specified temperature in this nip portion. The pressing section 132 includes two rollers 1321 and 1322 and the pressure belt 1323 mounted on these rollers. Out of the surface of the pressure belt 1323, a part stretched by the two rollers 1321 and 1322 is pressed against the circumferential surface of the heating roller 131, thereby forming a sufficiently wide nip portion between the heating roller 131 and the pressure belt 1323. The sheet having been subjected to the image fixing operation in this way is transported to the discharge tray 4 provided on the upper surface of the housing main body 3.

Further, a cleaner 71 is disposed facing the blade facing roller 83 in this apparatus. The cleaner 71 includes a cleaner blade 711 and a waste toner box 713. The cleaner blade 711 removes foreign matters such as toner remaining on the transfer belt after the secondary transfer and paper powder by holding the leading end thereof in contact with the blade facing roller 83 via the transfer belt 81. Foreign matters thus removed are collected into the waste toner box 713. Further, the cleaner blade 711 and the waste toner box 713 are constructed integral to the blade facing roller 83. Accordingly, when the blade facing roller 83 moves, the cleaner blade 711 and the waste toner box 713 move together with the blade facing roller 83.

Figure 5:
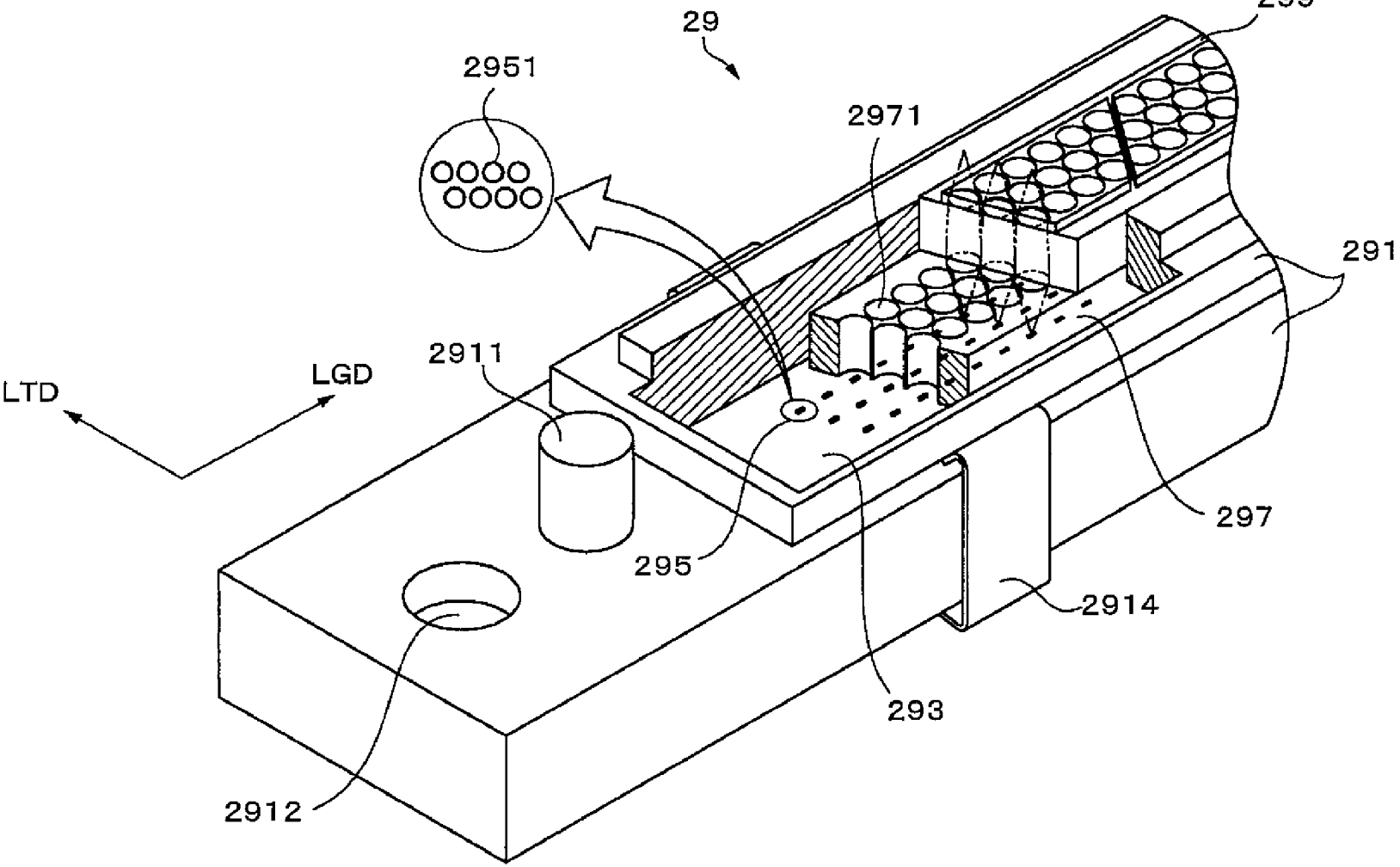
FIG. 5 is a perspective view schematically showing an embodiment of the line head according to the invention.
Figure 6:
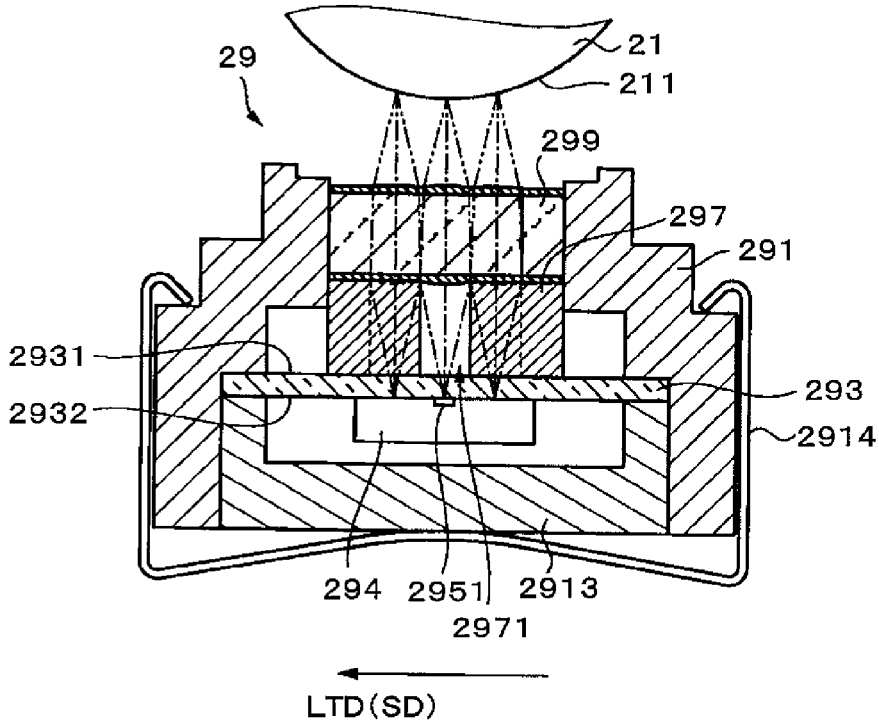
FIG. 6 is a sectional view along width direction of the embodiment of the line head according to the invention.

FIG. 5 is a perspective view schematically showing an embodiment of the line head according to the invention, and FIG. 6 is a sectional view along width direction of the embodiment of the line head according to the invention. In this embodiment, the line head 29 is arranged to face the surface of the photosensitive drum such that the longitudinal direction LGD of the line head 29 is parallel to the main scanning direction MD and the width direction LTD substantially normal to the longitudinal direction LGD is parallel to the sub scanning direction SD. In other words, the main scanning direction MD and the sub scanning direction SD of the photosensitive drum 21 correspond to the longitudinal direction LGD and the width direction LTD of the line head 29 in this embodiment. It should be noted that the longitudinal direction LGD corresponds to a "first direction" of the invention, the width direction LTD to a "second direction" of the invention and the main scanning direction MD to a "direction corresponding to the first direction" of the invention.

In FIG. 5, the line head 29 includes a case 291 whose longitudinal direction is a direction parallel to the main scanning direction MD, and a positioning pin 2911 and a screw insertion hole 2912 are provided at each of the opposite ends of the case 291. The line head 29 is positioned relative to the photosensitive drum 21 shown in FIG. 3 by fitting the positioning pins 2911 into positioning holes perforated in an unillustrated photosensitive drum cover. The photosensitive drum cover covers the photosensitive drum 21 and is positioned relative to the photosensitive drum 21. Further, the line head 29 is positioned and fixed relative to the photosensitive drum 21 by screwing fixing screws into screw holes (not shown) of the photosensitive drum cover via the screw insertion holes 2912 to be fixed.

In FIGS. 5 and 6, the case 291 carries a microlens array 299 in which imaging lenses are arrayed at positions facing a surface 211 of the photosensitive drum 21, and includes a light shielding member 297 and a head substrate 293 as a substrate inside, the light shielding member 297 being closer to the microlens array 299 than the head substrate 293. The head substrate 293 is a transparent glass substrate. Further, a plurality of light emitting element groups 295 are provided on an under surface 2932 of the head substrate 293 (surface opposite to a top surface 2931 facing the light shielding member 297 out of two surfaces of the head substrate 293). The plurality of light emitting element groups 295 are two-dimensionally, discretely arranged on the under surface 2932 of the head substrate 293 while being spaced by specified distances in the longitudinal direction LGD and in the width direction LTD as shown in FIG. 5. Here, each light emitting element group 295 is formed by two-dimensionally arraying a plurality of light emitting elements 2951 as shown in a section circled in FIG. 5. The arrangement of these is described in detail later.

In this embodiment, organic ELs are used as the light emitting elements. Specifically, in this embodiment, organic ELs are arranged as the light emitting elements 2951 on the under surface 2932 of the head substrate 293. Light beams emitted from the plurality of light emitting elements 2951 in a direction toward the photosensitive drum 21 propagate toward the light shielding member 297 via the head substrate 293. In this embodiment, all the light emitting elements are constructed such that the wavelengths of light beams emitted therefrom are equal to each other. Although the organic ELs are used as the light emitting elements 2951, the specific construction of the light emitting elements 2951 is not limited to this and, for example, LEDs (light emitting diodes) may be used as the light emitting elements 2951. In this case, the substrate 293 may not be a glass substrate and the LEDs may be provided on the top surface 2931 of the substrate 293.

In FIGS. 5 and 6, the light shielding member 297 includes a plurality of light guiding holes 2971 in one-to-one correspondence with the plurality of light emitting element groups 295. Light beams emitted from the light emitting elements 2951 belonging to the light emitting element groups 295 are guided to the microlens array 299 by the light guiding holes 2971 in one-to-one correspondence with the plurality of light emitting element groups 295. The light beams having passed through the light guiding holes 2971 are focused as spots on the surface 211 of the photosensitive drum 21 by the microlens array 299 as shown by chain double-dashed line.

As shown in FIG. 6, an underside lid 2913 is pressed to the case 291 via the glass substrate 293 by a retainer 2914. Specifically, the retainer 2914 has an elastic force to press the underside lid 2913 toward the case 291, and seals the inside of the case 291 light-tight (that is, so that light does not leak from the inside of the case 291 and so that light does not intrude into the case 291 from the outside) by pressing the underside lid 2913 by means of the elastic force. It should be noted that a plurality of the retainers 2914 are provided at a plurality of positions in the longitudinal direction LGD of the case 291 shown in FIG. 5. The light emitting element groups 295 are covered with a sealing member 294.

Figure 7:
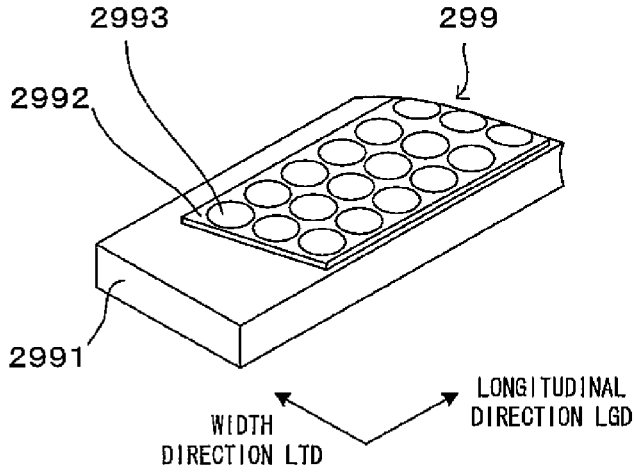
FIG. 7 is a schematic partial perspective view of the microlens array.
Figure 8:
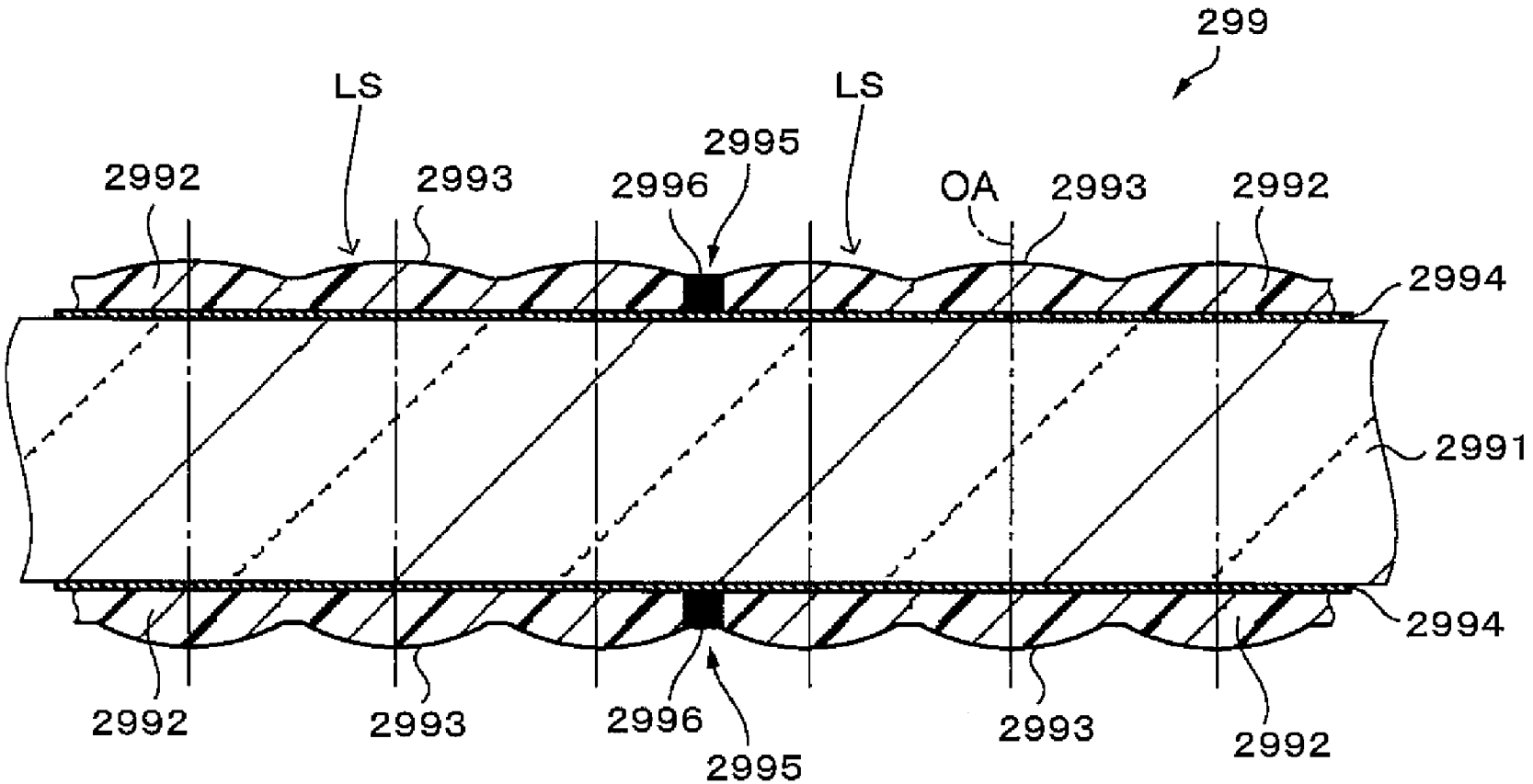
FIG. 8 is a partial sectional view of the microlens array in the longitudinal direction.
Figure 9:
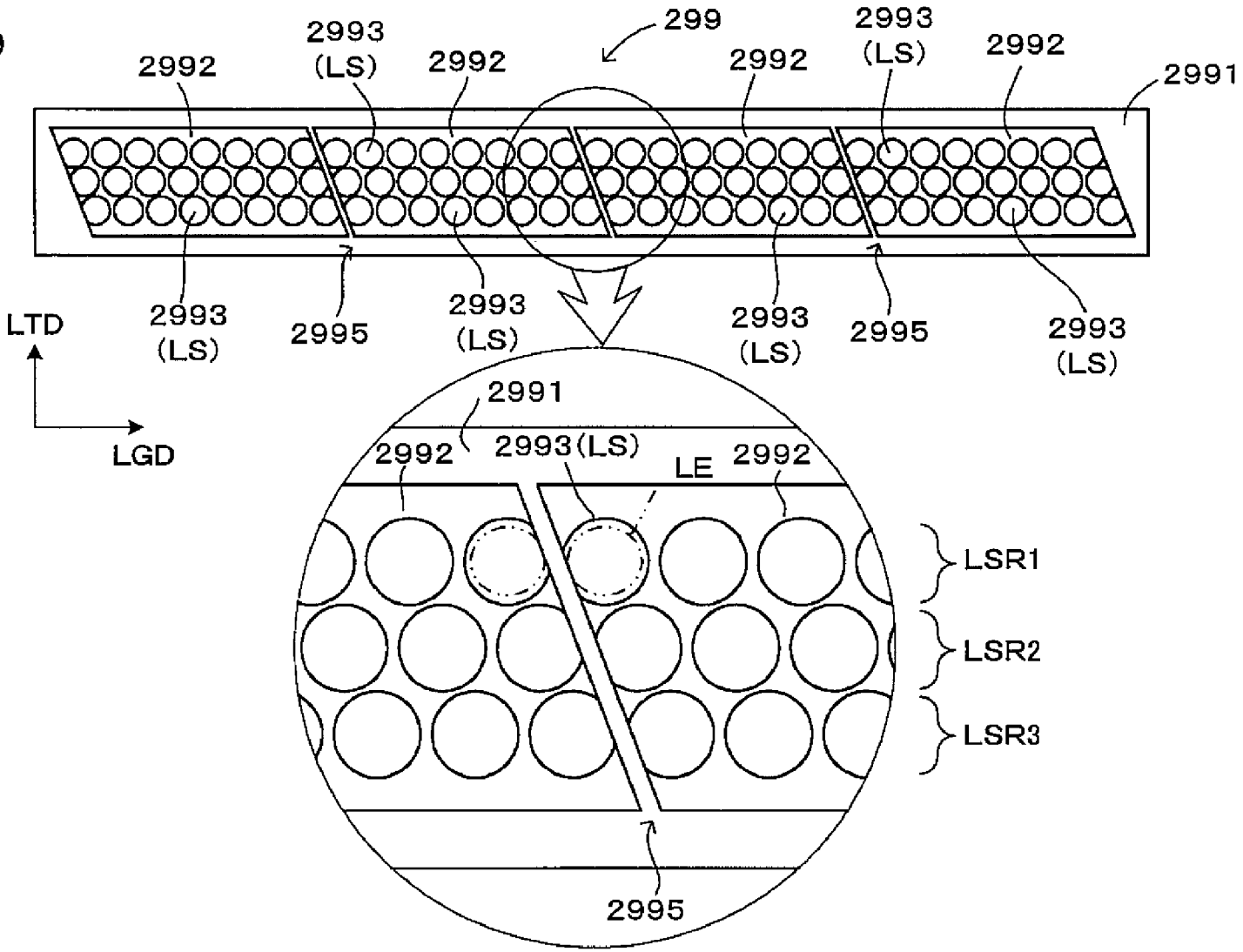
FIG. 9 is a plan view of the microlens array

FIG. 7 is a schematic partial perspective view of the microlens array, FIG. 8 is a partial sectional view of the microlens array in the longitudinal direction, and FIG. 9 is a plan view of the microlens array. In FIGS. 7 and 8, the microlens array 299 includes a glass substrate 2991 as a transparent substrate and a plurality of (eight in this embodiment) plastic lens substrates 2992. Since FIGS. 7 to 9 are partial views, they do not show all the parts.

In FIGS. 7 and 8, the plastic lens substrates 2992 are provided on the both surfaces of the glass substrate 2991. Specifically, as shown in FIG. 9, four plastic lens substrates 2992 are combined in a straight line and adhered to one surface of the glass substrate 2991 by an adhesive 2994. The shape of the microlens array 299 in plan view is rectangular. On the other hand, the shape of the plastic lens substrates 2992 is a parallelogram, and clearances 2995 are formed between the four plastic lens substrates 2992. Further, as shown in FIGS. 8 and 9, the clearances 2995 may be filled with a light absorbing material 2996, which can be selected from a wide variety of materials having a property of absorbing light beams emitted from the light emitting elements 2951. For example, resin containing fine carbon particles and the like can be used. An enlarged view of the vicinity of the clearance 2995 is shown in a circle of FIG. 9.

The lenses 2993 are so arrayed as to form three lens rows LSR1 to LSR3 in the longitudinal direction LGD of the microlens array 299. The respective rows are arranged while being slightly displaced in the longitudinal direction LGD, and lens columns LSC are arrayed oblique to shorter sides of the rectangle in the case of viewing the microlens array 299 from above. The clearances 2995 are formed between the lens columns LSC along the lens columns LSC, and correspond to "combined positions" of the invention.

The respective clearances 2995 are so formed as not to enter lens effective ranges LE of the lenses 2993. The lens effective range LE is an area where the light beams emitted from the light emitting element group 295 pass. As a method for forming the clearances 2995 in such a manner as not to enter lens effective ranges LE of the lenses 2993, there are a method for forming the end surfaces of the plastic lens substrates defining the clearances 2995 beforehand in such a manner as not to enter the lens effective ranges LE and a method for integrally forming a plurality of plastic lens substrates and, thereafter, cutting them in such a manner as not to enter the lens effective ranges LE.

Four plastic lens substrates 2992 are adhered to the other surface by the adhesive 2994 corresponding to the above four lens substrates 2992. In this way, a biconvex lens is formed as an imaging lens by two lenses 2993 arranged in one-to-one correspondence on the both surfaces of the glass substrate 2991. It should be noted that the plastic lens substrates 2992 and the lenses 2993 can be integrally formed by resin injection molding using a die.

The two lenses 2993 forming the imaging lens have a common optical axis OA shown in dashed-dotted line. These plurality of lenses are arranged in one-to-one correspondence with the plurality of light emitting element groups 295 shown in FIG. 5. In this specification, an optical system comprised of the two lenses 2993 and the glass substrate 2991 held between the lenses 2993 is called a "microlens LS". The microlenses LS as the imaging lenses are two-dimensionally arranged in conformity with the arrangement of the light emitting element groups 295 while being mutually spaced apart by specified distances in the longitudinal direction LGD (direction corresponding to the main scanning direction MD) and in the width direction LTD (direction corresponding to the sub scanning direction SD).

In the case of providing the clearances 2995 as above, that is, in the case of forming the lens array 299 by combining the plurality of lens substrates 2992, it is difficult to combine the lens substrates 2992 as designed and the lenses LS arranged at the opposite sides of the clearances 2995 might be relatively displaced in some cases. Accordingly, in this embodiment, the plurality of light emitting element groups 295 are arranged in one-to-one correspondence with the microlenses LS arranged as above, but the device construction is differentiated in the vicinities where the lens substrates 2992 are combined (vicinities of the combined positions) and the other parts. The device construction and operation are described in each case below.

Figure 10:
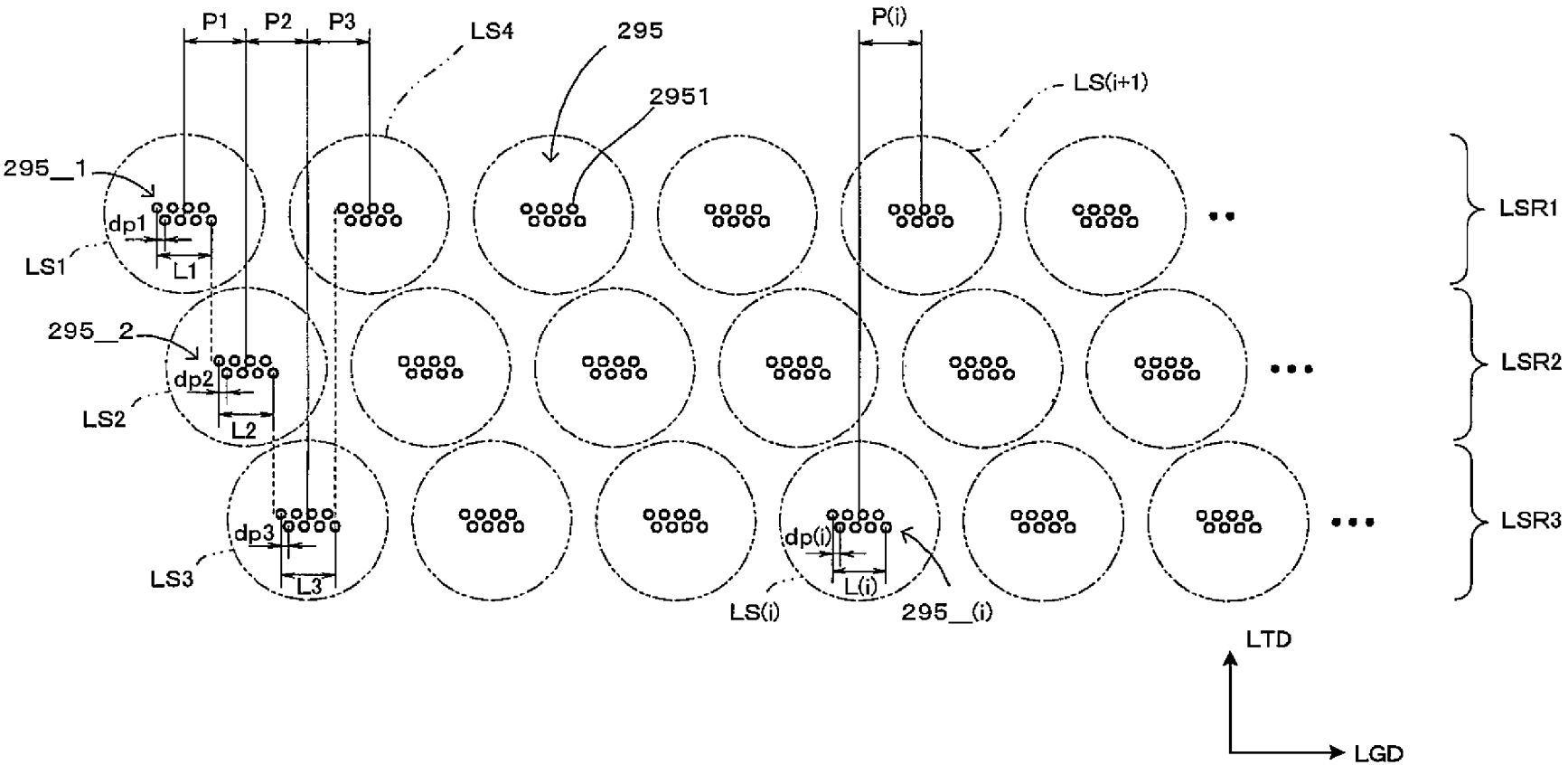
FIG. 10 is a diagram showing the arrangement relationship of the microlenses on the lens substrate and the light emitting element groups corresponding to the microlenses.

FIG. 10 is a diagram showing the arrangement relationship of the microlenses on the lens substrate and the light emitting element groups corresponding to the microlenses. In this line head, a specified number of light emitting element groups 295 are arrayed while being mutually spaced apart in the longitudinal direction LGD to form the light emitting element group row (295R in FIG. 2). A plurality of ("three" in this embodiment) light emitting element group rows are arranged in the width direction LTD, whereby the plurality of light emitting element groups 295 are arranged in a staggered manner. A spacing between the light emitting element groups 295 adjacent to each other in the longitudinal direction LGD is equal to the distance between the optical axes of the microlenses LS. For example, as shown in FIG. 10, a distance P1 between the first lens LS1 and the second lens LS2, a distance P2 between the second lens LS2 and the third lens LS3, . . . in the longitudinal direction LGD are equal. Further, distances in the longitudinal direction LGD between the light emitting element groups 295 corresponding to the lenses LS1 to LS3 are equal to the above distances.

Each of the light emitting element groups 295 excluding those relating to special lens pairs to be described later includes eight light emitting elements 2951, which are arranged as follows. Specifically, in each light emitting element group 295, four light emitting elements 2951 are aligned at specified pitches (=twice the element pitch dpi) in the longitudinal direction LGD to form a light emitting element row (2951R in FIG. 1). Further, two light emitting element rows are arranged in the width direction LTD. Furthermore, a shift amount of the light emitting element rows in the longitudinal direction LGD is the element pitch dpi. Thus, in each light emitting element group 295, all the light emitting elements 2951 are arranged at mutually different longitudinal positions spaced apart by the element pitch dpi. Accordingly, in each light emitting element group 295, light beams emitted from the eight light emitting elements 2951 are focused on the surface of the photosensitive drum 21 (hereinafter, "photosensitive surface") at mutually different positions in the main scanning direction MD by the microlens LS. In this way, eight spots are formed side by side in the main scanning direction MD to form a spot group SG. More specifically, the spot group SG is formed as follows.

Figure 11:
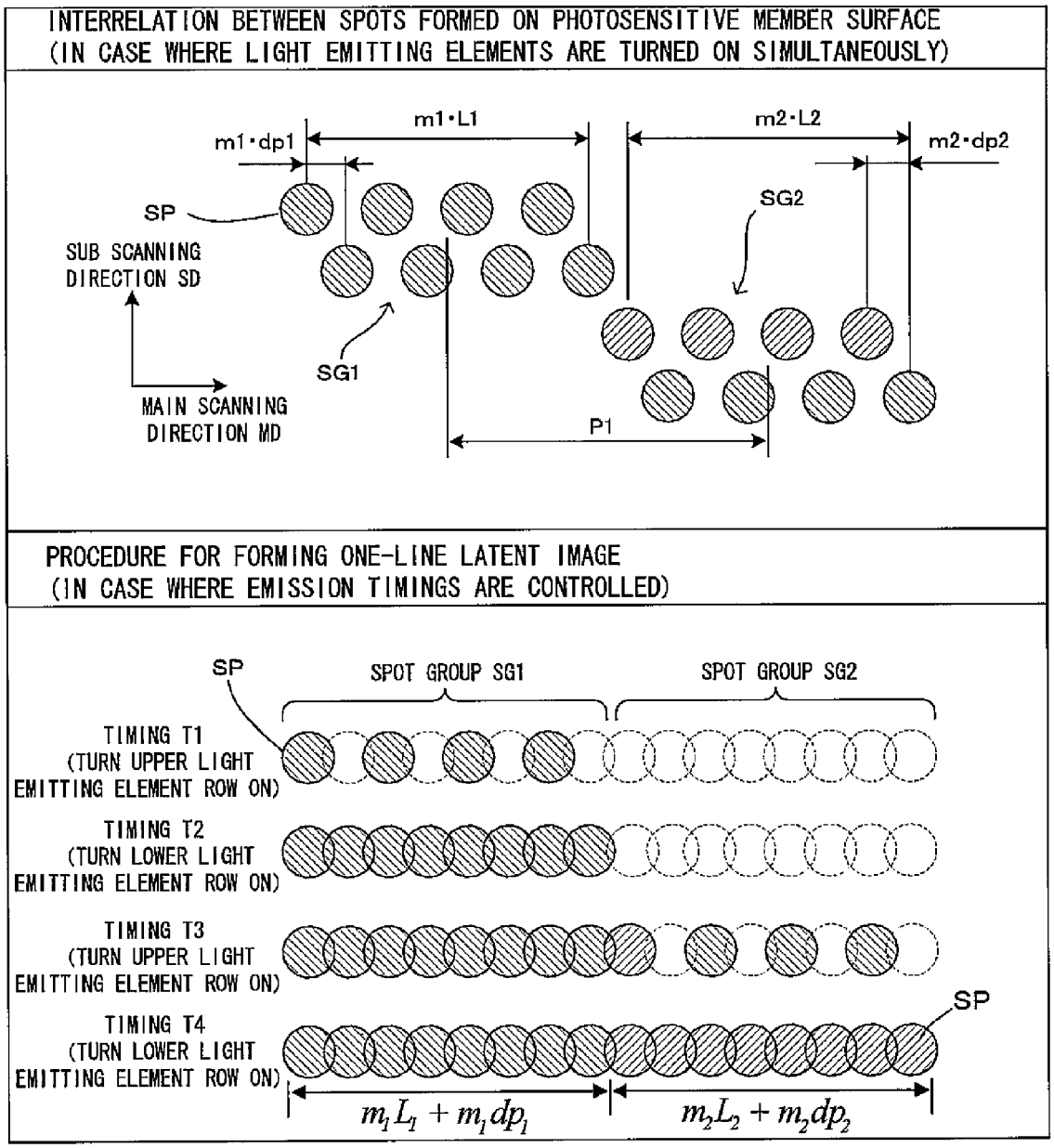
FIG. 11 is a diagram showing the positions of spots formed on the photosensitive surface by the line head.

FIG. 11 is a diagram showing the positions of spots formed on the photosensitive surface by the line head and diagrammatically shows a state where spots are formed by a light emitting element group 295_1 corresponding to the first lens LS1 in FIG. 10 and a light emitting element group 295_2 corresponding to the second lens LS2. It should be noted that a "spot group SG1" in FIG. 11 denotes a group of the spots SP formed by the light emitting element group 295_1 at the upstream side (left side in FIG. 10) and a "spot group SG2" denotes a group of the spots SP formed by the light emitting element group 295_2 at the downstream side (right side in FIG. 10). As shown in an upper part of FIG. 11, if the light emitting elements 2951 are simultaneously turned on, the spot groups SG1 and SG2 formed on the photosensitive surface are also two-dimensionally arranged.

Accordingly, in this embodiment, the light emitting elements 2951 constituting the light emitting element row are turned on to emit light beams at timings in conformity with a rotational movement of the photosensitive drum 21 in each light emitting element row as shown in a lower part of FIG. 11. In other words, the turn-on timings of the light emitting element rows constituting the light emitting element groups 295 are differentiated as follows in conformity with the rotational movement of the photosensitive drum 21.

(a) Timing T1: Turn the upper light emitting element row of the light emitting element group 295_1 on (b) Timing T2: Turn the lower light emitting element row of the light emitting element group 295_1 on (c) Timing T3: Turn the upper light emitting element row of the light emitting element group 295_2 on (d) Timing T4: Turn the lower light emitting element row of the light emitting element group 295_2 on Thus, the spots SP formed by the upper light emitting element rows and those formed by the lower light emitting element rows can be aligned in the main scanning direction MD only by this timing adjustment. In this way, the spots SP can be aligned in a line in the main scanning direction MD by a simple emission timing adjustment.

Figure 12:
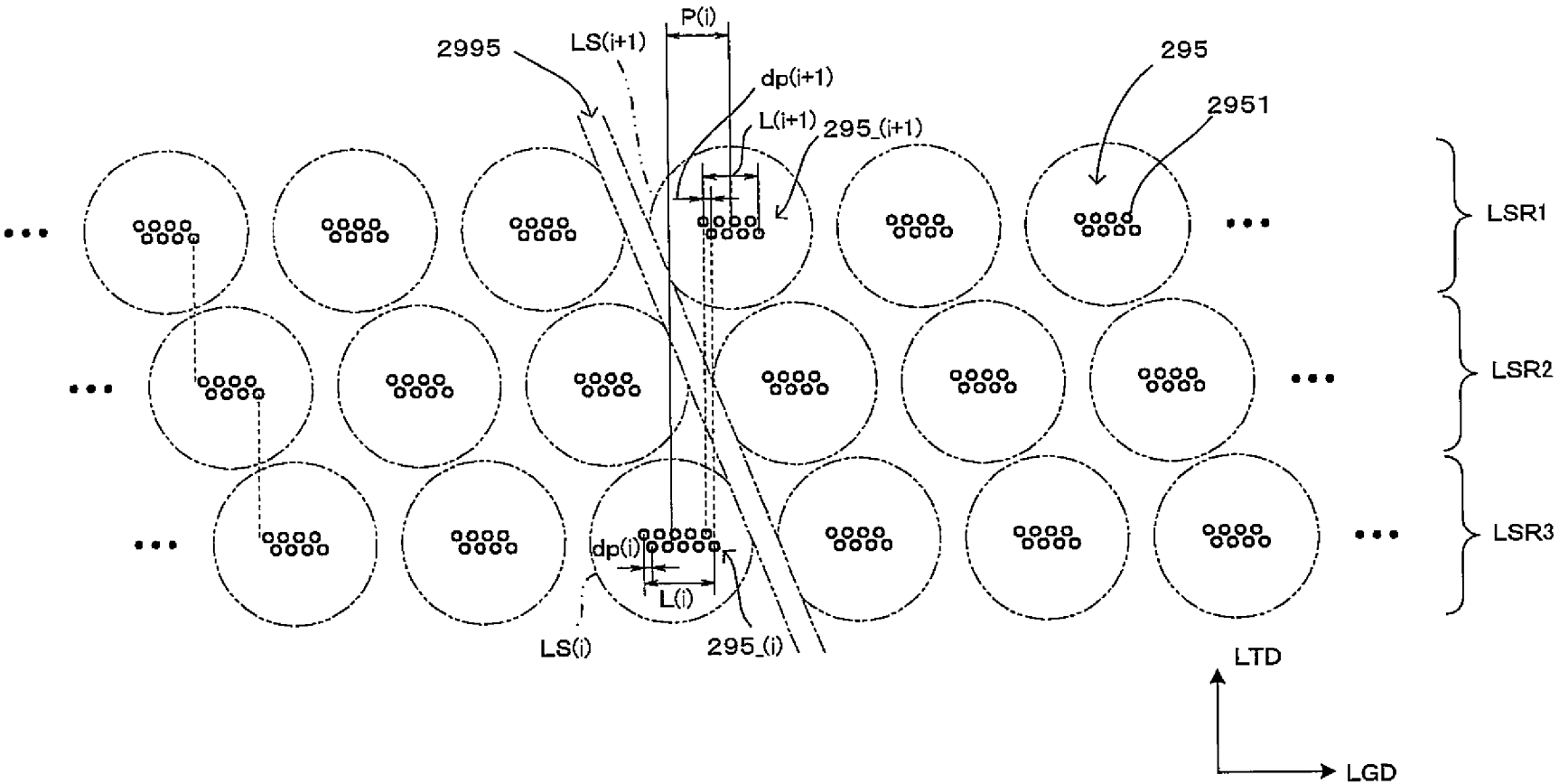
FIG. 12 is a diagram showing the arrangement relationship of the microlenses and the light emitting element groups in the vicinity of the combined position.

FIG. 12 is a diagram showing the arrangement relationship of the microlenses and the light emitting element groups in the vicinity of the combined position. In this vicinity of the combined position as well, the arrangement relationship and operation of the microlenses and the light emitting element groups are basically the same as shown in FIG. 11. In other words, a plurality of lens pairs, a lens LS(i−1) and a lens LS(i) in FIG. 12 for instance, are formed on the same lens substrate 2992 in order to form the spot groups adjacent to each other in the main scanning direction MD, and the spot groups are formed similar to the lens pairs (lenses LS1 and LS2) by these lens pairs. However, the lens pairs paired at the opposite sides of the clearance 2995 and adapted to form the spot groups adjacent to each other in the main scanning direction MD (hereinafter, "special lens pairs"), the lens pairs each comprised of the lens LS(i) and a lens LS(i+1) in FIG. 12 for example, have a construction different from that of the lens pairs (hereinafter, "normal lens pairs") shown in FIG. 10. In other words, as shown in FIG. 12, in the light emitting element group 295 corresponding to the lens LS(i), two additional light emitting elements 2951 are provided. Specifically, in the light emitting element group 295_(*i*), five light emitting elements 2951 are aligned at specified pitches (=twice the element pitch dpi) in the longitudinal direction LGD to form the light emitting element row (2951R in FIG. 2). Further, two light emitting element rows are arranged in the width direction LTD. Furthermore, a shift amount of the light emitting element rows in the longitudinal direction LGD is the element pitch dpi.

Figure 13:
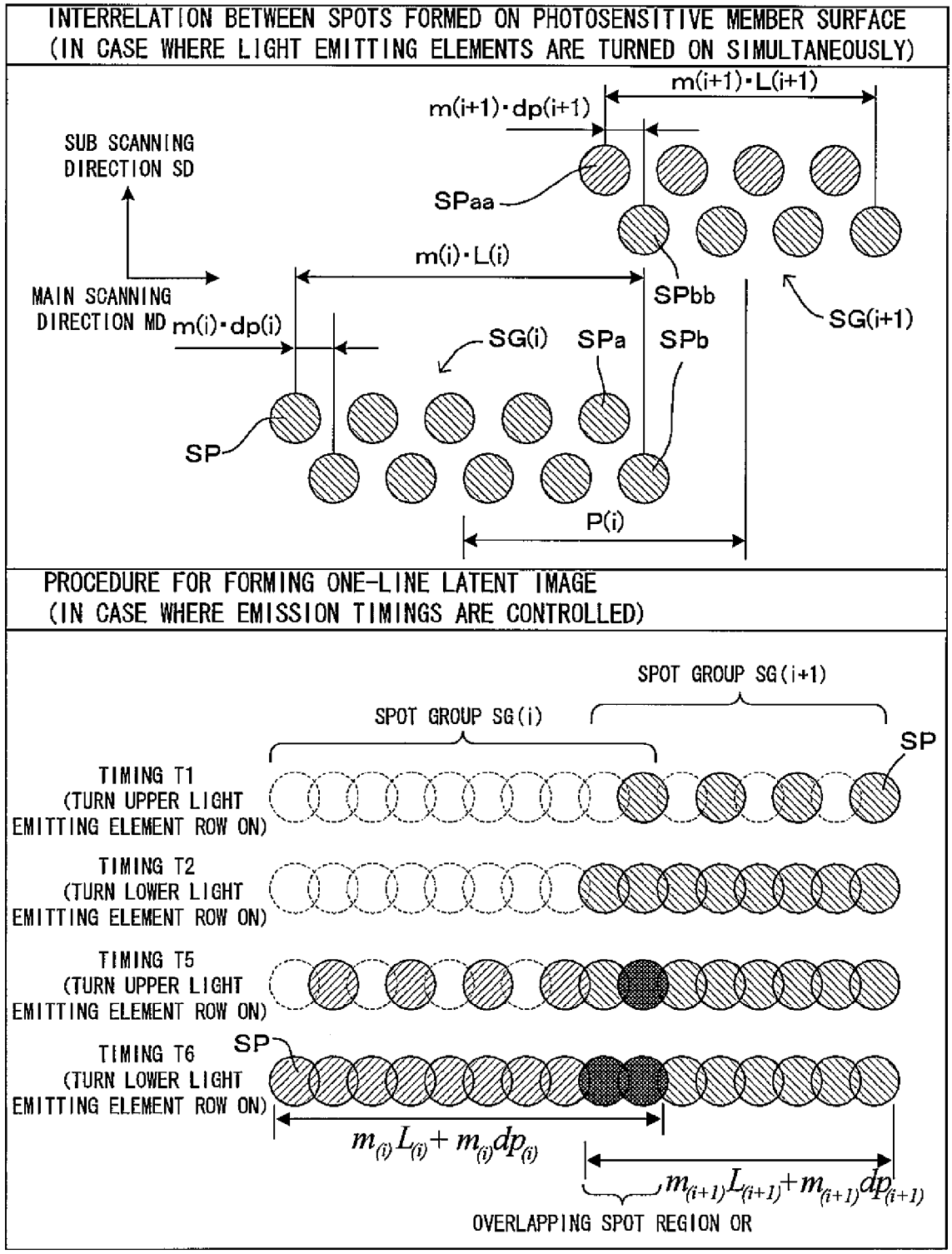
FIG. 13 is a diagram showing positions of spots formed on the photosensitive surface by the special lens pair and the light emitting element groups corresponding to the special lens pair.

FIG. 13 is a diagram showing positions of spots formed on the photosensitive surface by the special lens pair and the light emitting element groups corresponding to the special lens pair. In this embodiment, an inter-lens distance P(i) between the lenses LS(i) and LS(i+1) constituting the special lens pair satisfies the following expression:

$$m(i)\cdot L(i)+m(i+1)\cdot L(i+1)>2P(i)-\{m(i)\cdot dp(i)+m(i+1)\cdot dp(i+1)\} \quad (2)$$

where m(i) represents an absolute value of an optical magnification of the lens LS(i), L(i) represents a width in the longitudinal direction LGD of the light emitting element group which faces the lens LS(i), dp(i) represents a pitch of light emitting elements 2951 in the longitudinal direction LGD in the light emitting element group facing the lens LS(i), m(i+1) represents an absolute value of an optical magnification of the lens LS(i+1), L(i+1) represents a width in the longitudinal direction LGD of the light emitting element group which faces the lens LS(i+1), and dp(i+1) represents a pitch of light emitting elements 2951 in the longitudinal direction LGD in the light emitting element group facing the lens LS(i+1). It is to be noted that pre-designed values, means of measured values, and the like may be used as the pitches dp(i) and dp(i+1).

Figure 14:
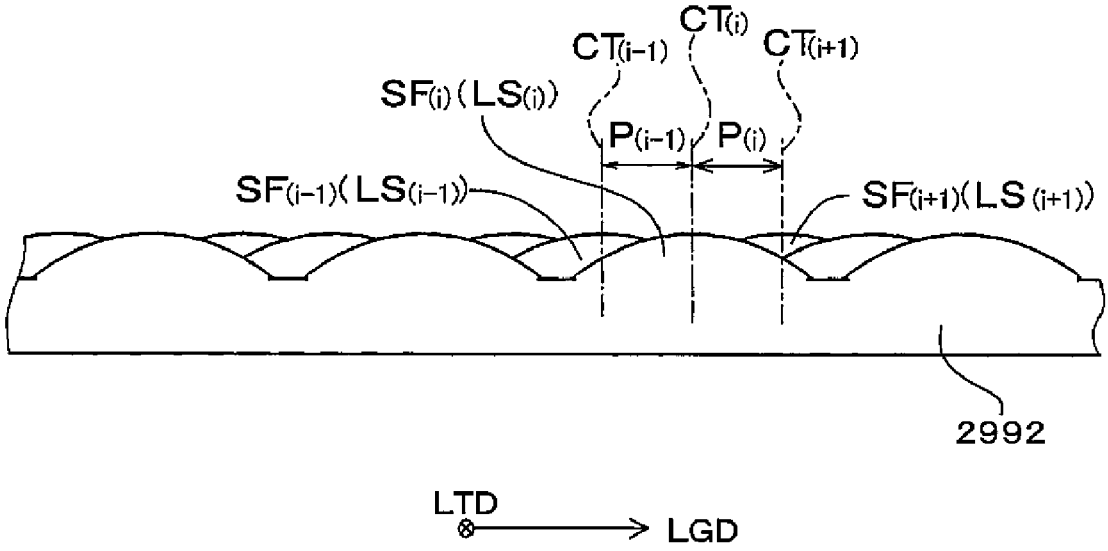
FIG. 14 is a diagram showing the inter-lens distance.

Here, the inter-lens distance P(i) is described. FIG. 14 is a diagram showing the inter-lens distance and corresponds to a side view when the lens array 299 is seen in the width direction LTD. In FIG. 14, only lens surfaces provided on one of two surfaces of the lens array 299 are shown. Identified by SF are lens surfaces (curved surfaces) of the lenses LS. For example, a lens surface SF(i) is the lens surface of the lens LS(i). Identified by CT are the centers of the lens surfaces SF For example, a lens surface center CT(i) is the center of the lens surface SF(i). This center CT is a point where a sag (sagitta) amount is largest, and the centers CT of two lens surfaces SF forming the lens LS are both located on an optical axis OA. In this specification, this center CT is called a "lens surface center" or merely a "lens center". As shown in FIG. 14, the inter-lens distance P(i) is a distance in the longitudinal direction LGD between the lenses LS(i) and LS(i+1) for forming spot groups SG adjacent in the main scanning direction MD, and given as a distance in the longitudinal direction LGD between the lens centers CT(i) and CT(i+1) of the respective lenses LS(i) and LS(i+1).

A width L(i) in the longitudinal direction LGD or the like of the light emitting element group 295 can be calculated, for example, as an inter-centroid distance between two light emitting elements 2951 at the opposite ends in the longitudinal direction LGD. Further, a pitch dp(i) or the like can be calculated as an inter-centroid distance of two light emitting elements 2951 as targets in the longitudinal direction LGD.

Upon forming the spots by the special lens pair constructed in this way, spot groups SG(i) and SG(i+1) formed adjacent to each other in the main scanning direction MD partly overlap each other to form an overlapping spot region OR. Specifically, in this overlapping spot region OR, some (spots SPa and SPb in FIG. 13) of the spots by the light emitting element group 295 corresponding to the lens LS(i) and some (spots SPaa and SPbb in FIG. 13) of the spots by the light emitting element group 295 corresponding to the lens LS(i+1) overlap. In this specification, the spots SPa, SPb, SPaa and SPbb forming the overlapping spot region OR are called "overlapping spots".

When exposure is made to the photosensitive surface using the line head 29 constructed as above, a two-dimensional latent image LI as shown in FIGS. 15A and 15B is obtained. Specifically, the spot groups adjacent to each other form the overlapping spot region OR by partly overlapping (FIG. 15A). This brings about the following effects. Specifically, upon producing the lens array 299, the lenses LS(i) and LS(i+1) paired at the opposite sides of the combined position (clearance 2995) of the lens substrates 2992 are relatively displaced due to assembling errors of the lens substrates 2992 and the like in some cases. If the lenses of the special lens pair are relatively displaced, a clearance is formed between the spot groups. On the other hand, since the special lens pair is so constructed as to satisfy the above relational expression (2) in this embodiment, the spots can be formed without causing these problems (FIG. 15B). In an image forming apparatus using the line head 29 constructed as above as an exposing device, high-quality images can be formed.

As described above, according to this embodiment, the inter-lens distance P(i) between the lenses LS(i) and LS(i+1) constituting the special lens pairs (lenses LS(i) and LS(i+1) in FIG. 12) out of the lens pairs forming the spot groups SG adjacent to each other in the main scanning direction MD (lenses LS(k) and LS(k+1) where k=1, 2, 3, . . . ) satisfies the above relational expression (2). Accordingly, even if the lenses of the special lens pairs are relatively displaced, the formation of clearances between the spot groups SG(i) and SG(i+1) can be prevented. Therefore, in an image forming apparatus adopting such a lens array 299, high-quality toner images can be formed without forming vertical lines.

Specifically, in the above embodiment, the line head 29 as an exposure head of the invention includes an i-th imaging optical system (lens LS(i)) and an (i+1)-th imaging optical system (lens LS(i+1)) arranged in a first direction (longitudinal direction LGD), a plurality of light emitting elements (light emitting element group 295) which emit lights to be imaged by the i-th imaging optical system LS(i), and a plurality of light emitting elements (light emitting element group 295) which emit lights to be imaged by the (i+1)-th imaging optical system LS(i+1). And the inter-optical-system distance P(i) (inter-lens distance P(i)) in the first direction LGD between the i-th imaging optical system LS(i) and the (i+1)-th imaging optical system LS(i+1) satisfies the following expression:

$$m(i)\cdot L(i)+m(i+1)\cdot L(i+1)>2P(i)-(m(i)\cdot dp(i)+m(i+1)\cdot dp(i+1)) \quad (2)$$

where m(i) represents an absolute value of the optical magnification of the i-th imaging optical system LS(i), L(i) represents a width in the first direction LGD of the plurality of light emitting elements to be imaged by the i-th imaging optical system LS(i), dp(i) represents a pitch between the light emitting elements in the first direction LGD in the plurality of light emitting elements to be imaged by the i-th imaging optical system LS(i), m(i+1) represents an absolute value of the optical magnification of the (i+1)-th imaging optical system LS(i+1), L(i+1) represents a width in the first direction LGD of the plurality of light emitting elements to be imaged by the (i+1)-th imaging optical system LS(i+1), and dp(i+1) represents a pitch between the light emitting elements in the first direction LGD in the plurality of light emitting elements to be imaged by the (i+1)-th imaging optical system LS(i+1).

In the line head thus constructed, the i-th imaging optical system LS(i) and the (i+1)-th imaging optical system LS(i+1) are provided, and the plurality of light emitting elements are provided for each of the i-th imaging optical system LS(i) and the (i+1)-th imaging optical system LS(i+1). Each of the i-th imaging optical system LS(i) and the (i+1)-th imaging optical system LS(i+1) can image lights from the plurality of light emitting elements (light emitting element group 295) to form a plurality of spots (spot group). In addition, the i-th imaging optical system LS(i) and the (i+1)-th imaging optical system LS(i+1) are configured to satisfy the expression (2). Accordingly, spots can be satisfactorily formed by suppressing the production of clearances between spot groups. Further, by performing image formation using such an exposure head, high-quality toner images can be formed without producing vertical lines.

In other words, in the above embodiment, the line head 29 as an exposure head of the invention includes a first imaging optical system (lens LS(i)) and a second imaging optical system (lens LS(i+1)) arranged in a first direction (longitudinal direction LGD), a plurality of light emitting elements (light emitting element group 295) which emit lights to be imaged by the first imaging optical system LS(i), and a plurality of light emitting elements (light emitting element group 295) which emit lights to be imaged by the second imaging optical system LS(i+1). And the inter-optical-system distance P1 (inter-lens distance P(i)) in the first direction between the first imaging optical system LS(i) and the second imaging optical system LS(i+1) satisfies the following expression:

$$m1\cdot L1+m2\cdot L2>2P1-(m1\cdot dp1+m2\cdot dp2) \quad (1)$$

where m1 represents an absolute value of the optical magnification of the first imaging optical system LS(i), L1 represents a width in the first direction of the plurality of light emitting elements to be imaged by the first imaging optical system LS(i), dp1 represents a pitch between the light emitting elements in the first direction in the plurality of light emitting elements to be imaged by the first imaging optical system LS(i), m2 represents an absolute value of the optical magnification of the second imaging optical system LS(i+1), L2 represents a width in the first direction of the plurality of light emitting elements to be imaged by the second imaging optical system LS(i+1), and dp2 represents a pitch between the light emitting elements in the first direction in the plurality of light emitting elements to be imaged by the second imaging optical system LS(i+1).

In the line head thus constructed, the first imaging optical system LS(i) and the second imaging optical system LS(i+1) are provided, and the plurality of light emitting elements are provided for each of the first imaging optical system LS(i) and the second imaging optical system LS(i+1). Each of the first imaging optical system LS(i) and the second imaging optical system LS(i+1) can image lights from the plurality of light emitting elements to form a plurality of spots (spot group). In addition, the first imaging optical system LS(i) and the second imaging optical system LS(i+1) are configured to satisfy the expression (1). Accordingly, spots can be satisfactorily formed by suppressing the production of clearances between spot groups. Further, by performing image formation using such an exposure head, high-quality toner images can be formed without producing vertical lines.

Further, in the above embodiment, the light transmissive substrate (light transmissive lens substrate, plastic lens substrate 2992) is provided with a curved surface (lens surfaces SF(i), SF(i+1)), and the array substrate (light transmissive array substrate, glass substrate 2991) is provided with the light transmissive substrate (plastic lens substrate 2992). Furthermore, as shown in FIGS. 8 and 12, the light transmissive substrate (plastic lens substrate 2992) provided with a curved surface (lens surface SF(i)) of the first imaging optical system (lens LS(i)) and the light transmissive substrate (plastic lens substrate 2992) provided with a curved surface (lens surface SF(i+1)) of the second imaging optical system (lens LS(i+1)) are different from each other. That is, the light transmissive substrate (plastic lens substrate 2992) which is provided with a curved surface (lens surface SF(i)) of the first imaging optical system (lens LS(i)) and the light transmissive substrate (plastic lens substrate 2992) which is provided with a curved surface (lens surface SF(i+1)) of the second imaging optical system (lens LS(i+1)) are combined to form the line head (exposure head) 29. However, the first imaging optical system (lens LS(i)) and the second imaging optical system (lens LS(i+1)) which are at the opposite sides of the combined positions are relatively displaced due to assembling errors and the like in some cases. As a result, a clearance is formed between the spot group by the first imaging optical system (lens LS(i)) and the spot group by the second imaging optical system (lens LS(i+1)) in some cases. On the contrary, in the above embodiment, the line head 29 is structured such that the first imaging optical system (lens LS(i)) and the second imaging optical system (lens LS(i+1)) satisfy the above formula (1). Hence, it is very preferable that the clearance between the spot groups is suppressed. This makes it possible to form spots favorably.

Further, the base material of the array substrate 2991 being glass, this embodiment is preferable. Because it is advantageous in suppressing a change of the position of the curved surface (lens surfaces SF(i), SF(i+1)) due to the temperature change, since the coefficient of linear expansion of glass is relatively small.

Further, since a value (m(k)dp(k)) and a value (m(k+1)dp(k+1)) are equal in all the spot groups SG(k), where k=1, 2, 3, . . . , in the above embodiment, spot pitches Psp of the respective spot groups SG are equal, whereby good spot formation can be carried out. Further, high-quality images can be obtained by performing image forming operations using such a line head.

In the above embodiment, the light shielding member 297 is disposed between the imaging optical system (lens 2993) and a plurality of light emitting elements (light emitting element group 295) which emit lights which are imaged by the imaging optical system 2993. The light shielding member 297 is provided with a plurality of light guiding holes 2971 through which the light from the plurality of light emitting elements (light emitting element groups 295) toward the imaging optical system 2993 pass. In such a structure, lights emitted from the light emitting elements 2951 pass through the light guiding holes 2971 and are incident upon the corresponding imaging optical system 2993. Thus, crosstalk, in which lights emitted from the light emitting elements 2951 are incident upon the non-corresponding imaging optical system 2993, is suppressed and satisfactory spot formation is possible.

Further, the first imaging optical system may be provided with a curved surface upon which the lights emitted from the plurality of light emitting elements are incident, the second imaging optical system may be provided with a curved surface upon which the lights emitted from the plurality of light emitting elements are incident, and the curved surface of the first imaging optical system and the curved surface of the second imaging optical system may be arranged on a light transmissive array substrate to form a lens array.

Further, the first imaging optical system may be provided with a plurality of curved surfaces including a first curved surface and a second curved surface, the second imaging optical system may be provided with a plurality of curved surfaces including a third curved surface and a fourth curved surface, and it may be structured such that a lens array constituted by the first curved surface and the third curved surface and a lens array constituted by the second curved surface and the fourth curved surface are different. That is, in this structure, two or more lens arrays are provided. Hence, it is possible to improve the freedom of lens design and to form preferable spots.

Further, the base material of the array substrate may be glass. Because it is advantageous in suppressing a change of the position of the curved surface due to the temperature change, since the coefficient of linear expansion of glass is relatively small.

Further, the light transmissive substrate may be provided with the curved surface and the array substrate may be provided with the light transmissive substrate.

At this time, the curved surface of the first imaging optical system and the curved surface of the second imaging optical system may be provided on the different light transmissive substrates. In this case, the light transmissive substrate which is provided with a curved surface of the first imaging optical system and the light transmissive substrate which is provided with a curved surface of the second imaging optical system are combined to form the exposure head. However, the first imaging optical system and the second imaging optical system which are at the opposite sides of the combined positions are relatively displaced due to assembling errors and the like in some cases. As a result, a clearance is formed between the spot group by the first imaging optical system and the spot group by the second imaging optical system in some cases. Consequently, for such a structure, it is very preferable to suppress generation of the clearance between the spot groups by constructing the exposure head such that the above formula (1) is satisfied. This makes it possible to form spots favorably.

Further, it may be structured that the plurality of light emitting elements which are imaged by the first imaging optical system and the plurality of light emitting elements which are imaged by the second imaging optical system are provided on different element substrates. In this case, the element substrate which is provided with a plurality of light emitting elements which emit lights which are imaged by the first imaging optical system and the element substrate which is provided with a plurality of light emitting elements which emit lights which are imaged by the second imaging optical system are combined to construct the exposure head. However, due to an assembling error and the like, a clearance is formed between the spot group by the first imaging optical system and the spot group by the second imaging optical system in some cases. Consequently, for such a structure, it is very preferable to suppress generation of the clearance between the spot groups by constructing the exposure head such that the above formula (1) is satisfied. This makes it possible to form spots favorably.

Further, a plurality of imaging optical systems including at least the first imaging optical system and the second imaging optical system may be provided, and N (N is an integer equal to or larger than 3) imaging optical system rows in which a plurality of imaging optical systems are arranged in the first direction may be disposed. However, in the structure in which N imaging optical system rows are disposed in this way, the imaging optical system belonging to the first imaging optical system row and the imaging optical system belonging to the N-th imaging optical system row are widely distanced. Accordingly, these imaging optical systems might be relatively displaced due to production errors and the like, and a clearance might be formed between the spot groups as described above. Consequently, it is structured such that the above formula (1) is satisfied, that is, the first imaging optical system belongs to the first imaging optical system row and the second imaging optical system belongs to the N-th imaging optical system row. Hence, it is very preferable that the clearance between the spot groups is suppressed. This makes it possible to form spots favorably Further, when it is structured that a value m(1)dp(1) and a value m(2)dp(2) are equal, spot pitches formed on the image plane are equal, and good spot formation can be carried out. Further, high-quality images can be obtained by performing image forming operations using such an exposure head.

Further, an aperture diaphragm may be disposed between the imaging optical system and a plurality of light emitting elements which emit lights which are imaged by the imaging optical system. With such a structure, it is possible to form spots in a preferable optical characteristic.

Further, a light shielding member may be disposed between the imaging optical system and the plurality of light emitting elements which emit lights which are imaged by the imaging optical system, and the light shielding member may be provided with a plurality of light guiding holes through which the lights from the plurality of light emitting elements toward the imaging optical system pass. With such a structure, satisfactory spot formation in which crosstalk is suppressed is possible.

Further, the first and the second imaging optical systems may be structured such that m1<1 and m2<1 are satisfied, where m1 and m2 are absolute values of the optical magnification of the first and the second imaging optical systems, respectively. Such a structure reduces the light from the light emitting element to image, and hence, it is advantageous in forming a high-resolution spot.

Further, the first and the second imaging optical systems may be structured such that they form inverted images. Such a structure can comparatively simplify the first and the second imaging optical systems, and hence, it is advantageous in reducing cost of the exposure head.

Another embodiment of a line head according to the invention comprises a plurality of light emitting elements which are disposed as a group for each light emitting element group, and a lens array which includes a lens for each light emitting element group. The lens is opposed to the light emitting element group, and focuses on an image plane light beams emitted from the light emitting element group to form a spot group. The plurality of light emitting element groups are disposed in a first direction. An inter-lens distance P(i) between lenses which constitutes a lens pair, the lens pair being at least one lens pair among lens pairs which form spot groups adjacent to each other in a direction corresponding to the first direction satisfies the following expression:

$$m(i)\cdot L(i)+m(i+1)\cdot L(i+1)>2P(i)-\{m(i)\cdot dp(i)+m(i+1)\cdot dp(i+1)\} \quad (2)$$

where m(i) represents an optical magnification of one lens, L(i) represents a width in the first direction of the light emitting element group which faces the one lens, dp(i) represents a pitch of light emitting elements in the first direction in the light emitting element group facing the one lens, m(i+1) represents an optical magnification of the other lens, L(i+1) represents a width in the first direction of the light emitting element group which faces the other lens, and dp(i+1) represents a pitch of light emitting elements in the first direction in the light emitting element group facing the other lens.

Another embodiment of an image forming apparatus according to the invention comprises a latent image carrier whose surface is transported in a predetermined transportation direction and a line head which forms a latent image on the latent image carrier. The line head comprises a plurality of light emitting elements which are disposed as a group for each light emitting element group, and a lens array which includes a lens for each light emitting element group. The lens is opposed to the light emitting element group, and focuses on an image plane light beams emitted from the light emitting element group to form a spot group. The plurality of light emitting element groups are disposed in a first direction. An inter-lens distance P(i) between lenses which constitutes a lens pair, the lens pair being at least one lens pair among lens pairs which form spot groups adjacent to each other in a direction corresponding to the first direction satisfies the following expression:

$$m(i)\cdot L(i)+m(i+1)\cdot L(i+1)>2P(i)-\{m(i)\cdot dp(i)+m(i+1)\cdot dp(i+1)\} \quad (2)$$

where m(i) represents an optical magnification of one lens, L(i) represents a width in the first direction of the light emitting element group which faces the one lens, dp(i) represents a pitch of light emitting elements in the first direction in the light emitting element group facing the one lens, m(i+1) represents an optical magnification of the other lens, L(i+1) represents a width in the first direction of the light emitting element group which faces the other lens, and dp(i+1) represents a pitch of light emitting elements in the first direction in the light emitting element group facing the other lens.

In each embodiment (a line head and an image forming apparatus) structured as above, the plurality of light emitting element groups are disposed in a first direction. In each light emitting element group, the light beam emitted from the light emitting element group is imaged on the image plane such as the latent image carrier by the lens facing this light emitting element group to form a spot group. Hence, a plurality of spot groups are formed in a direction corresponding to the first direction. Accordingly, when the spot groups adjacent to each other in the direction corresponding to the first direction are relatively displaced, a clearance is generated between the spot groups. However, in this embodiment, the inter-lens distance P(i) between lenses which constitute a lens pair, the lens pair being at least one lens pair among lens pairs which form spot groups which are adjacent to each other in a direction corresponding to the first direction satisfies the above formula (2). Hence, the spot groups partially overlap. As a result, a clearance is not generated between the spot groups and favorable spot formation can be performed even when these spot groups are relatively displaced. Further, it is possible to form a toner image of high quality without generating vertical lines by forming images using such a line head.

A combination of a plurality of lens substrates having lenses may be used as a lens array. However, in the lens array with such a structure, lens pairs paired at the opposite sides of the combined positions of the lens substrates are relatively displaced due to assembling errors of the lens substrates and the like in some cases. If a pair of lenses for forming spot groups adjacent to each other in a direction corresponding to the first direction are relatively displaced out of these lens pairs, a clearance is formed between the spot groups. Accordingly, in a line head and an image forming apparatus adopting such a lens array, it is desirable to structure such that an inter-lens distance P(i) of the lenses constituting this lens pair satisfies the above relational expression (2). This makes it possible to form a toner image of a good quality without forming vertical lines.

Further, also in the case where a plurality of element substrates having light emitting element groups are combined, a problem similar to the case where a lens array which is a combination of a plurality of lens substrates may occur. Consequently, it is desirable to structure such that an inter-lens distance P(i) of the lenses constituting a lens pair which form the spot groups adjacent to each other in the direction corresponding to the first direction among the lens pairs which are opposed to light emitting element group pairs which are paired with respect to the locations at which the element substrates are combined with each other. This makes it possible to form a toner image of a good quality without forming vertical lines.

Further, the similar problems described above occur in some cases in the line head in which the lens array is structured as follows. Specifically, in the lens array in which N (where N is an integer equal to or larger than 3) lens rows, each of which is comprised of a plurality of lenses arranged in the first direction, are disposed in a second direction different from the first direction, a lens constituting the first lens row in the second direction and a lens constituting the N-th lens row in the second direction are widely distanced in the second direction. Accordingly, the lens constituting the first lens row in the second direction and the lens constituting the N-th lens row in the second direction might be relatively displaced due to production errors and the like. If a relative displacement occurs in the lens pair for forming spot groups adjacent to each other in the direction corresponding to the first direction out of lens pairs constituted by these lenses, a clearance is formed between the spot groups. Thus, line heads and image forming apparatuses adopting such a lens array are preferably constructed such that an inter-lens distance P(i) of the lenses constituting the lens pair satisfies the above expression (2). This makes it possible to form a toner image of a good quality without forming vertical lines.

In the embodiment above, the above expression (2) is satisfied as for at least one lens pair which form spot groups adjacent to each other in the direction corresponding to the first direction. However, it may be structured that the above expression (2) is satisfied as for all the lens pairs which form spot groups adjacent to each other in the direction corresponding to the first direction.

Further, when it is structured that a value m(i)dp(i) and a value m(i+1)dp(i+1) are equal, spot pitches formed on the image plane are equal, and good spot formation can be carried out. Further, high-quality images can be obtained by performing image forming operations using such a line head.

C. Others

The present invention is not limited to the preferred embodiments described above but may be modified in a variety of manners to the extent not departing from the spirit of the invention.

For example, in the above embodiment, although only the special lens pairs satisfy the expression (2), all the lens pairs, that is, lenses LS(k) and LS(k+1), where k=1, 2, 3, . . . , for forming the spot groups SG adjacent to each other in the main scanning direction MD may satisfy the expression (2). In this case, the overlapping spot regions OR are formed between the adjacent spot groups SG.

Figure 16:
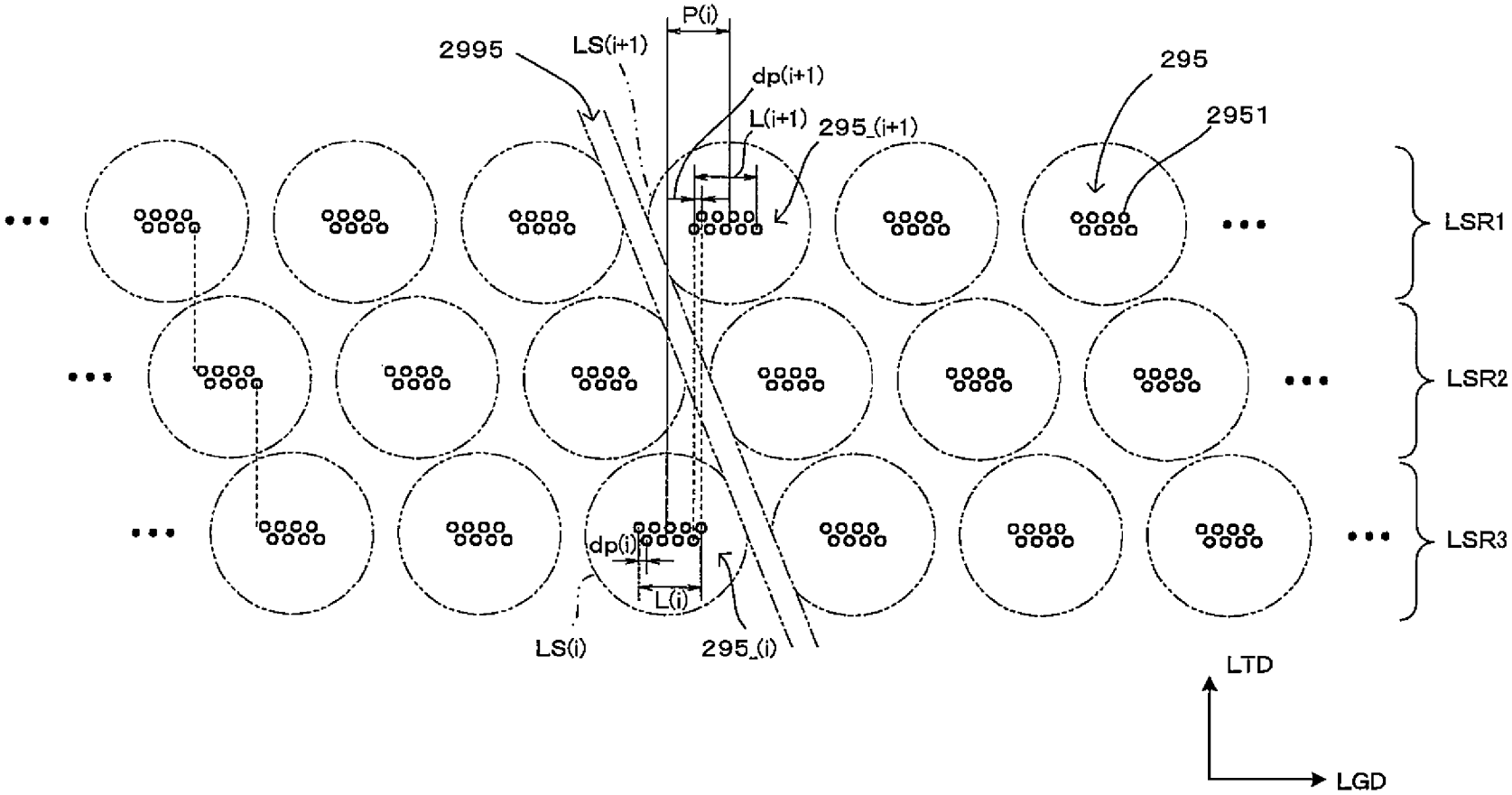
FIG. 16 is a diagram showing a modification of a line head according to the invention.

Further, in the above embodiment, the number of the light emitting elements 2951 constituting each light emitting element group 295_(*i*) is increased by two to form the overlapping spot region OR. Here, the number of the light emitting elements of the light emitting element group 295_(*i*+1) corresponding to the other lens LS(i+1) constituting each special lens pair may be increased by two or the number of light emitting elements may be increased by one in the light emitting element groups 295_(*i*), 295_(*i*+1) as shown in FIG. 16. Further, the number of the overlapping light emitting elements 2951 is not limited to "two" and is arbitrary.

Although the four lens substrates 2992 are combined in a straight line to form the lens array 299 in the above embodiment, the invention is applicable to line heads in general in which a lens array is formed by combining a plurality of lens substrates in an arbitrary manner. Specifically, in the line head in which a plurality of lens substrates are combined, out of the lens pairs paired at the opposite sides of the combined positions of the lens substrates, the lens pairs for forming the spot groups adjacent to each other in the direction (main scanning direction MD) corresponding to the longitudinal direction (first direction) LGD satisfy the expression (2). Therefore, functions and effects similar to those of the above embodiment can be obtained also in the line head and the image forming apparatus constructed as above.

Figure 17:
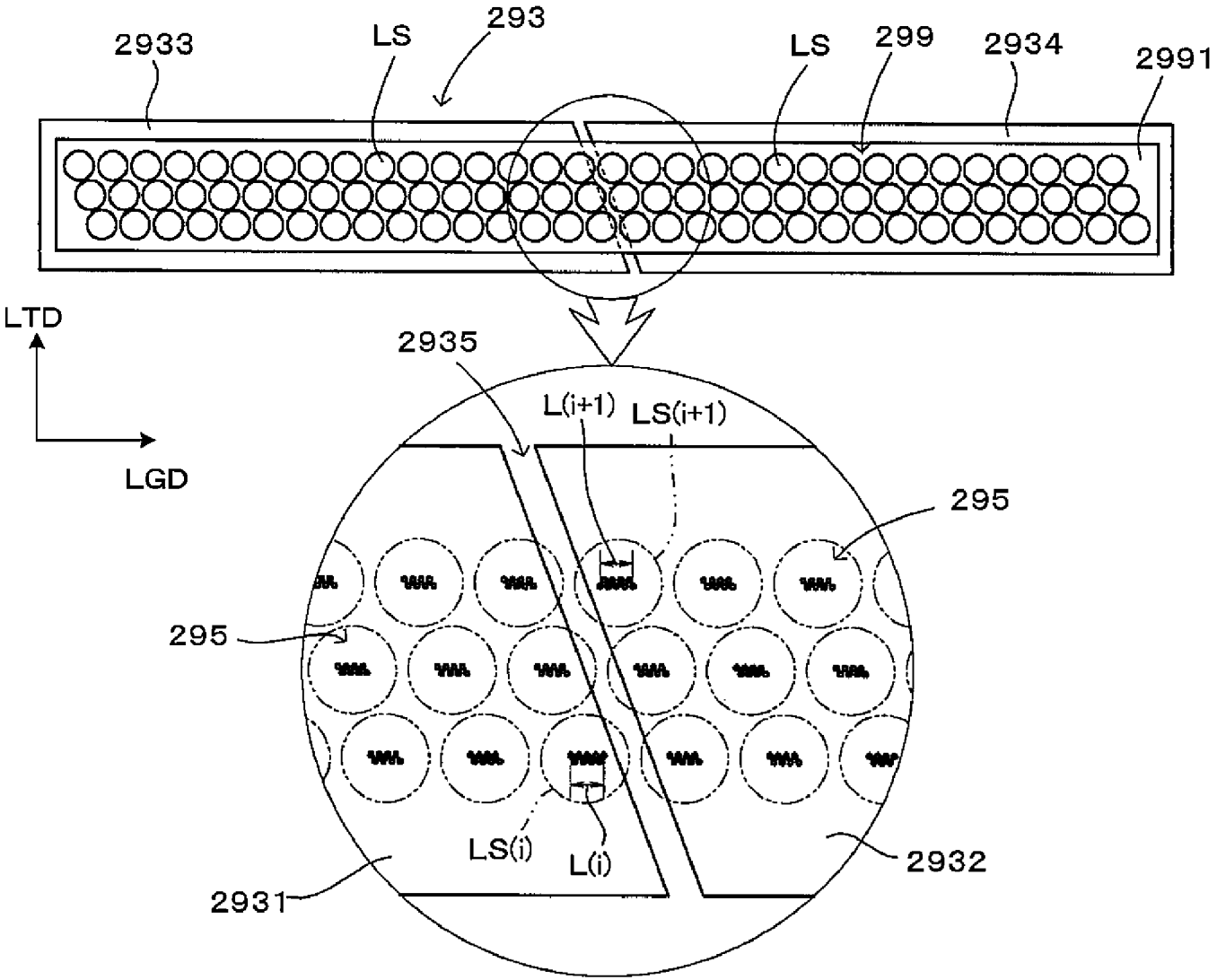
FIG. 17 is a diagram showing another modification of a line head according to the invention.

Further, although the lens array 299 is constructed by the dividing and assembling method in the above embodiment, the head substrate 293 may be constructed by the dividing and assembling method. The invention is applicable to line heads and image forming apparatuses using this head substrate. For example, as shown in FIG. 17, the head substrate 293 may be constructed by combining element substrates 2933 and 2934 formed with light emitting element groups 295. In this case, problems similar to those in the case of constructing the lens array by the dividing and assembling method might occur due to an assembling error at a combined position 2935 of the both element substrates 2933 and 2934. In other words, a vertical line might be formed between spot groups adjacent to each other in the main scanning direction MD. Accordingly, in the line heads and image forming apparatuses structured in this way, functions and effects similar to those of the above embodiment can be obtained by the following construction. Specifically, out of lens pairs facing the light emitting element group pairs paired at the opposite sides of the combined position 2935 of the both element substrates 2933 and 2934, a special lens pair, that is, lenses LS(i) and LS(i+1), for forming spot groups adjacent to each other in the main scanning direction MD corresponding to the longitudinal direction (first direction) LGD satisfies the expression (2). Thus, even if the light emitting element groups are displaced at the combined position 2935, good spot formation can be carried out and the formation of vertical lines can be reliably prevented.

In other words, in the line head shown in FIG. 17, the plurality of light emitting elements (light emitting element group 295) which are imaged by the first imaging optical system (lens LS(i)) and the plurality of light emitting elements (light emitting element group 295) which are imaged by the second imaging optical system (lens LS(i+1)) are disposed on different element substrates 2933 and 2934. That is, the element substrate 2933 which is provided with a plurality of light emitting elements which emit lights which are imaged by the first imaging optical system LS(i) and the element substrate 2934 which is provided with a plurality of light emitting elements which emit lights which are imaged by the second imaging optical system LS(i+1) are combined to construct the line head 29. Accordingly, due to an assembling error and the like, a clearance is formed between the spot group by the first imaging optical system LS(i) and the spot group by the second imaging optical system LS(i+1) in some cases. The line head 29 is structured such that the above formula (2) or the formula (1) is satisfied to deal with such a problem, and hence, the clearance between the spot groups is suppressed. This makes it possible to form spots favorably.

Further, the invention is also applicable to line heads and image forming apparatuses using a lens array 299 and a head substrate 293 produced without adopting the dividing and assembling method. For example, in a device shown in FIG. 18, lenses LS are arrayed such that three lens rows LSR1 to LSR3 are formed in the longitudinal direction LGD of the microlens array 299. In the lens array 299 having such an array, problems occur in some cases similar to the above embodiments. In other words, with respect to the width direction (second direction) LTD, the lenses constituting the first lens row LSR1 and those constituting the third lens row LSR3 are distanced in the width direction LTD. Accordingly, these lenses might be relatively displaced due to production errors and the like. If a relative displacement occurs in the lens pair for forming spot groups adjacent to each other in the main scanning direction MD corresponding to the longitudinal direction LGD, the lens pair comprised of lenses LS(i) and LS(i+1) in FIG. 18 for example, out of lens pairs constituted by these lenses, a clearance is formed between the spot groups. Thus, line heads and image forming apparatuses adopting such a lens array are preferably constructed such that an inter-lens distance P(i) between the lenses LS(i) and LS(i+1) satisfies the above expression (2). Therefore, high-quality toner images can be formed without forming vertical lines.

Figure 18:
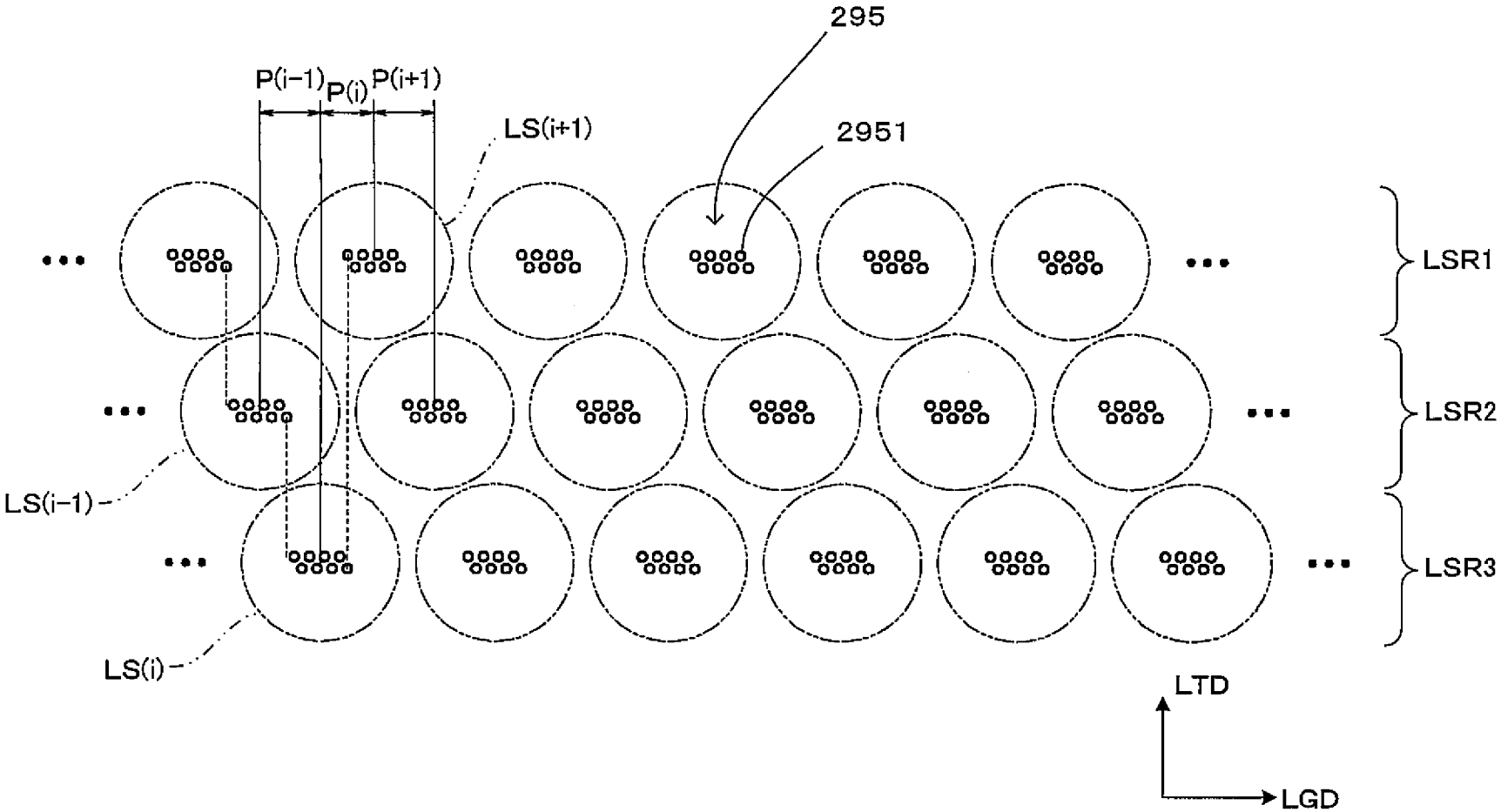
FIG. 18 is a diagram showing still another modification of a line head according to the invention.

In other words, in the line head 29 shown in FIG. 18, a plurality of imaging optical systems including at least the first imaging optical system (lens LS(i)) and the second imaging optical system (lens LS(i+1)) are provided. And N (N is an integer equal to or larger than 3) imaging optical system rows (lens rows LSR1, etc.) in which a plurality of imaging optical systems are arranged in the first direction (longitudinal direction LGD) are disposed. However, in the structure in which N imaging optical system rows LSR1 to LSR3 are disposed in this way, the imaging optical system LS(i) belonging to the first imaging optical system LSR1 and the imaging optical system LS(i+1) belonging to the N-th imaging optical system LSR3 are widely distanced. Accordingly, these imaging optical systems LS(i), LS(i+1) might be relatively displaced due to production errors and the like, and a clearance might be formed between the spot groups as described above. The line head 29 is structured such that the above formula (2) or the formula (1) is satisfied to deal with this, and hence, the clearance between the spot groups is suppressed. This makes it possible to form spots favorably.

Further, in the above embodiments, two light emitting element rows 2951R formed by aligning four or five light emitting elements 2951 at specified pitches in the longitudinal direction LGD are arranged in the width direction LTD. However, the configuration and arrangement (in other words, arrangement mode of a plurality of light emitting elements) of the light emitting element rows 2951R are not limited to these. In short, it is sufficient to arrange a plurality of light emitting elements 2951 at different positions in the longitudinal direction LGD.

Although the surface of the photosensitive drum 21 serves as the "image plane" of the invention in the above embodiments, the application subject of the invention is not limited to this. For example, the invention is also applicable to an apparatus using a photosensitive belt.

Further, although the invention is applied to the color image forming apparatus in the above embodiment, the application thereof is not limited to this and the invention is also applicable to monochromatic image forming apparatuses which form monochromatic images.

Figure 19:
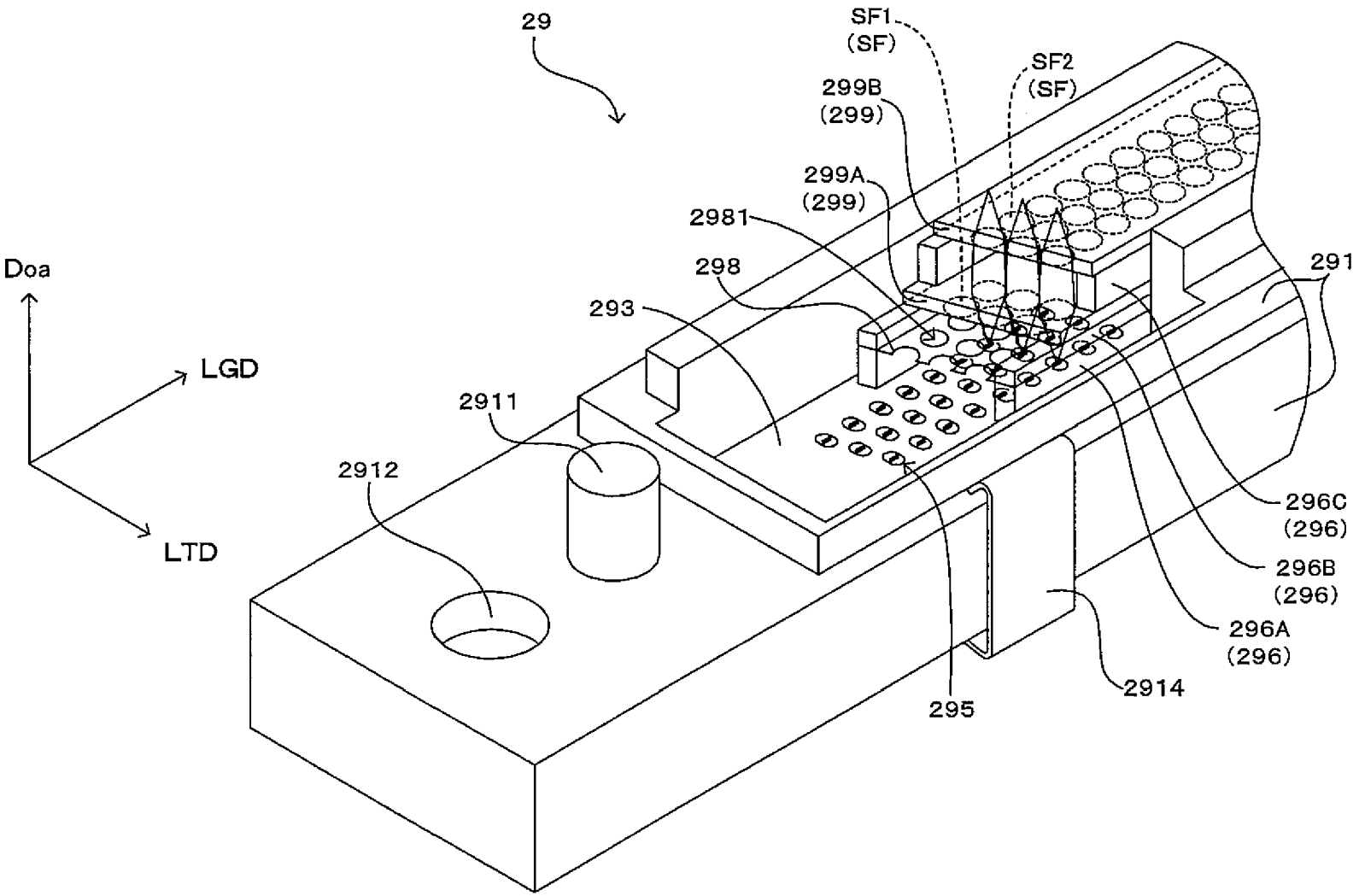
FIG. 19 is a perspective view schematically showing other structure of a line head.
Figure 20:
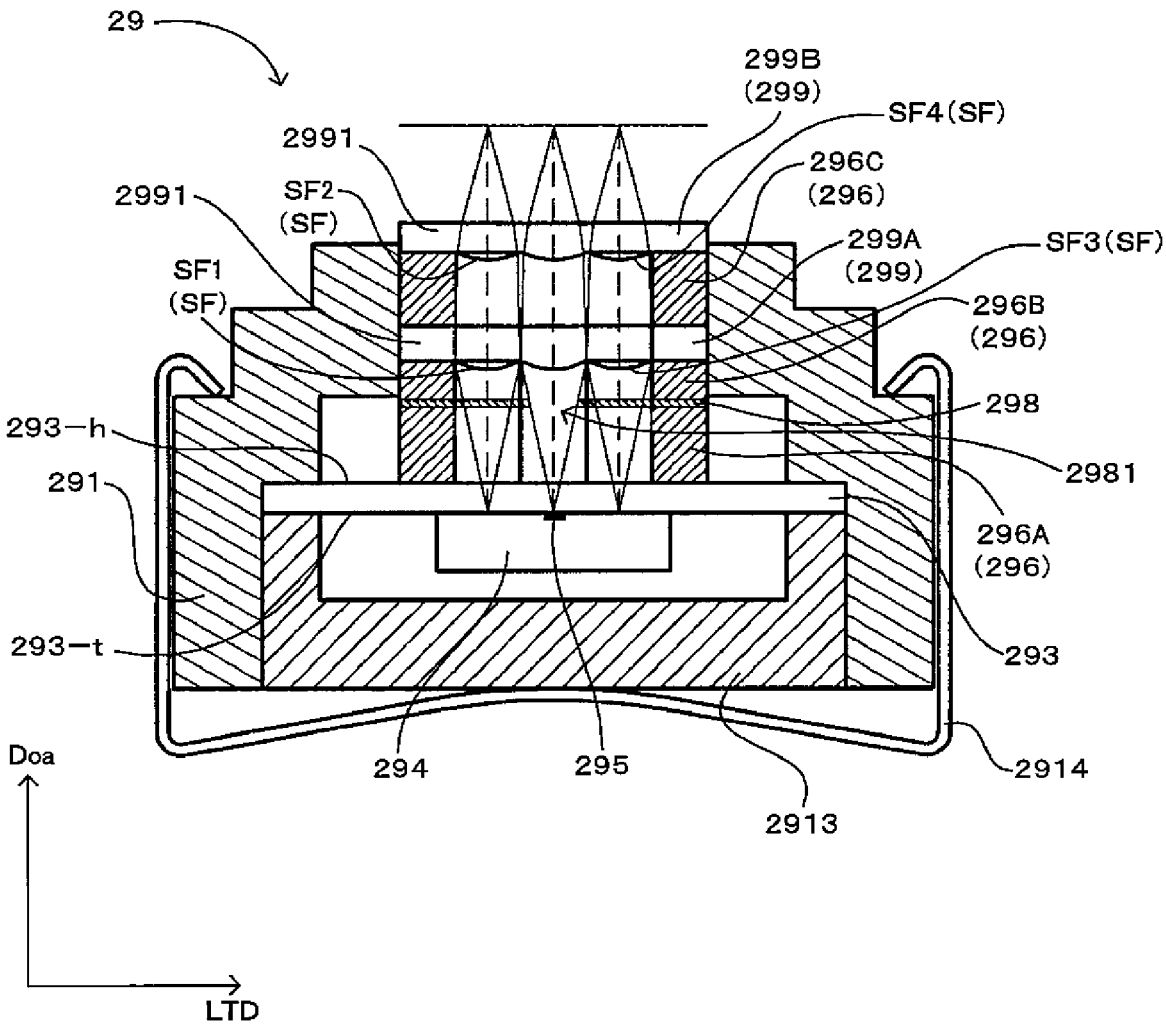
FIG. 20 is a cross sectional view of the line head shown in FIG. 19 taken along the width direction.

Further, the line head 29 in the above embodiment comprises one lens array 299. However, the number of the lens array is not limited to one and it may be more than one as in another structure described next. FIG. 19 is a perspective view schematically showing other structure of a line head. FIG. 20 is a cross sectional view of the line head shown in FIG. 19 taken along the width direction. Hereinafter, differences from the line head described above will mainly be described but common structures will simply be denoted at corresponding reference symbols to avoid redundant description.

As shown in FIGS. 19 and 20, an aperture plate 298 is arranged opposed to the head substrate 293 via a pedestal 296A. The aperture plate 298 is provided with an aperture diaphragm 2981 for each light emitting element group 295. The light beam emitted from the light emitting element group 295 is narrowed down by the aperture diaphragm 2981. In this way, the aperture diaphragm 2981 is provided, and hence, the incidence of unnecessary light beam upon the lens is suppressed, and spot formation can be performed with the favorable optical characteristic.

Two lens arrays 299 are arranged side by side at a side of the aperture plate 298 in the propagation direction Doa of the light beams. Specifically, a lens array 299A is arranged opposed to the aperture plate 298 via a pedestal 296B. Further, a lens array 299B is arranged opposed to the lens array 299A via a pedestal 296C. Each of the two lens arrays 299A and 299B includes a glass substrate (array substrate) 2991. The glass substrate 2991 is provided with a lens surface SF for each light emitting element group 295. Accordingly, the light beams from the light emitting element groups 295 are incident upon the respective lens surfaces (imaging optical systems) SF1 and SF2. In other words, the glass substrate 2991 functions as a light transmissive array substrate. In this way, in the line head 29, respective members of the head substrate 293, the aperture plate 298, the lens array 299A and the lens array 299B are arranged side by side in this order in the propagation direction Doa of the light beams, and the pedestals 296 are disposed between the respective members. The propagation direction Doa of the light beams is a direction which is orthogonal to the longitudinal direction LGD and to the width direction LTD, is a direction toward the surface of the photosensitive drum from the light emitting elements, and is parallel to or approximately parallel to the optical axis OA. Thus, in this embodiment, since the plurality of lens arrays 299 are arranged side by side in the propagation direction Doa of the light beam, it is possible to improve the freedom of optical design.

As described above, in the structure shown in FIGS. 19 and 20, a plurality of lens surfaces SF arranged side by side in the propagation direction Doa of the light beam constitute one imaging optical system. For example, a lens surface (first curved surface) SF1 and a lens surface (second curved surface) SF2 constitute one imaging optical system, and a lens surface (third curved surface) SF3 and a lens surface (fourth curved surface) SF4 constitute one imaging optical system. Further, the lens array 299A constituted by the lens surface (first curved surface) SF1 and the lens surface (third curved surface) SF3 is different from the lens array 299B constituted by the lens surface (second curved surface) SF2 and the lens surface (fourth curved surface) SF4. The invention can be applicable also to such a structure including the plurality of lens arrays 299A and 299B. That is, when the imaging optical system constituted by the lens surface (first curved surface) SF1 and the lens surface (second curved surface) SF2 and the imaging optical system constituted by the lens surface (third curved surface) SF3 and the lens surface (fourth curved surface) SF4 form spot groups adjacent in the main scanning direction MD, it is possible to suppress the clearance and to perform favorable exposing operation by constituting these two optical systems to satisfy the above formula (1) or the formula (2).

EXAMPLE

Next, an example of the invention is illustrated. The invention is not restricted by the following example and can be, of course, embodied while being suitably modified without departing from the gist described above and below, and any of such modifications is included in the technical scope of the invention.

Figure 22:
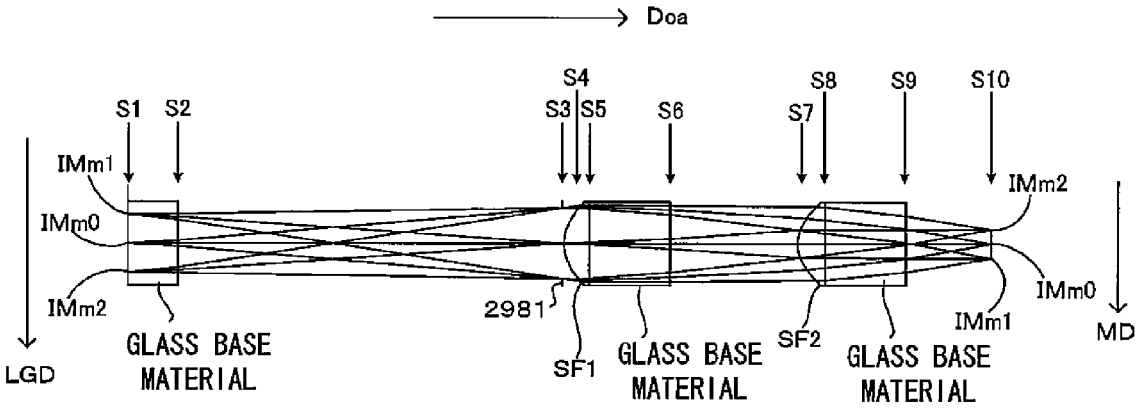
FIG. 22 is a sectional view of the optical system along the main scanning direction in the example.
Figure 23:
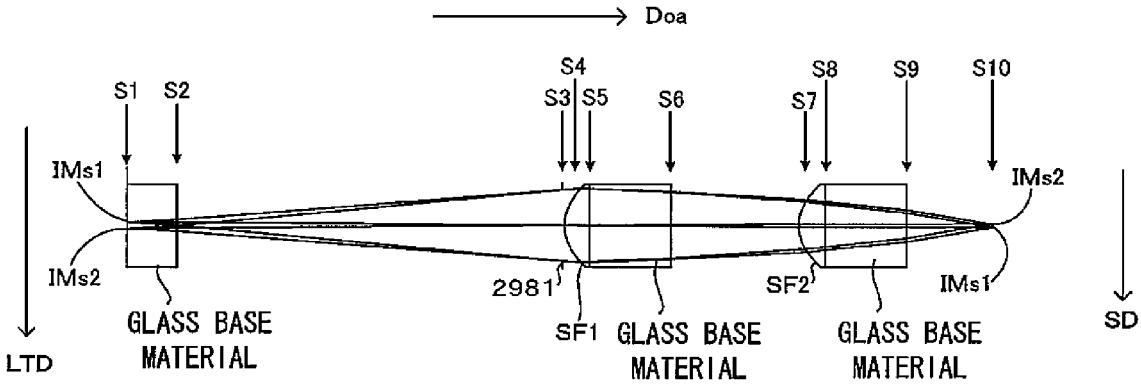
FIG. 23 is a sectional view of the optical system along the sub scanning direction in the example.

FIG. 21 shows data of an optical system in the example. In FIG. 21, main scanning direction coordinate x is a coordinate axis in the main scanning direction MD, sub scanning direction coordinate y is a coordinate axis in the sub scanning direction SD, and the origin of the coordinate axes x and y passes the optical axis OA. FIG. 22 is a sectional view of the optical system along the main scanning direction (longitudinal direction) in the example, and FIG. 23 is a sectional view of the optical system along the sub scanning direction (width direction) in the example. The planes of FIGS. 22 and 23 include the optical axis OA of the optical system. FIG. 24 shows conditions used in a simulation to calculate the optical paths shown in FIGS. 22 and 23.

As can be understood from FIGS. 21 to 24, this example corresponds to a case in which two lens arrays 299 are used. As shown in FIGS. 22 and 23, the object plane S1 corresponds to a back surface of a glass base material, and this example corresponds to a case in which an organic EL (electroluminescence) device of bottom emission type is used as the light emitting element 2951. As shown in FIG. 24, the wavelength of the light emitted from the light emitting element 2951 is 690 [nm].

The first lens surface SF1 and the second lens surface SF2 are both formed on the back surface of the glass base material. As shown in the columns of surface numbers S4 and S7 in FIG. 21, the respective lens surfaces SF1 and SF2 are free-form surfaces, that is, x-y polynomial surfaces. Further, the numerical aperture of image side is 0.29960.

As shown in FIG. 22, the object point OBm0 on the optical axis OA is imaged at the image point IMm0 on the optical axis OA by the imaging optical system. Further, the object points OBm1, OBm2 are inverted and imaged at the image points IMm1, IMm2 by the imaging optical system, respectively. Further, as shown in FIG. 23, the object points OBs1, OBs2 are inverted and imaged at the image points IMs1, IMs2 by the imaging optical system, respectively. That is, the imaging optical system forms an inverted image. Further, the absolute value of the optical magnification of the imaging optical system m is smaller than 1, that is, m<1, and the imaging optical system reduces the image to focus.

FIG. 25 shows examples of various values in the case where the invention is applied to the line head 29 which has the imaging optical system shown in FIGS. 21 to 24. Similar to the embodiment described above, the imaging optical systems LS(i), LS(i+1) form spot groups SG which are adjacent in the main scanning direction MD. As shown in FIG. 25, the inter-optical-system distance P(i) (inter-lens distance P(i)) in the first direction LGD between the i-th imaging optical system LS(i) and the (i+1)-th imaging optical system LS(i+1) satisfies the following expression.

$$m(i)\cdot L(i)+m(i+1)-L(i+1)>2P(i)-(m(i)\cdot dp(i)+m(i+1)\cdot dp(i+1)) \quad (2)$$

In FIG. 25 also, m(i) represents an absolute value of the optical magnification of the i-th imaging optical system LS(i), L(i) represents a width in the first direction LGD of the plurality of light emitting elements to be imaged by the i-th imaging optical system LS(i), dp(i) represents a pitch between the light emitting elements in the first direction LGD in the plurality of light emitting elements to be imaged by the i-th imaging optical system LS(i), m(i+1) represents an absolute value of the optical magnification of the (i+1)-th imaging optical system LS(i+1), L(i+1) represents a width in the first direction LGD of the plurality of light emitting elements to be imaged by the (i+1)-th imaging optical system LS(i+1), and dp(i+1) represents a pitch between the light emitting elements in the first direction LGD in the plurality of light emitting elements to be imaged by the (i+1)-th imaging optical system LS(i+1). Accordingly, spots can be satisfactorily formed by suppressing the production of clearances between spot groups.

Further, the first and the second imaging optical systems are structured such that m(i)<1 and m(i+1)<1 are satisfied, where m(i) and m(i+1) are absolute values of the optical magnification of the first and the second imaging optical systems, respectively, and hence, it is preferable. Because it is advantageous in forming a high-resolution spot, since the light from the light emitting element 2951 is reduced to be imaged.

Further, the first and the second imaging optical systems are structured to form inverted images, which makes it possible to comparatively simplify the first and the second imaging optical systems. In other words, the line head (exposure head) 29 has a structure advantageous in reducing cost and the like.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention It is therefore contemplated that the appended claims will cover any such modifications or embodiments as fall within the true scope of the invention.

What is claimed is:

1. An exposure head, comprising:

a first imaging optical system and a second imaging optical system which are arranged in a first direction;

a first light emitting element group including plural light emitting elements which emit light to be imaged by the first imaging optical system; and a second light emitting element group including plural light emitting elements which emit light to be imaged by the second imaging optical system, wherein an inter-optical-system distance P1 in the first direction between the first imaging optical system and the second imaging optical system satisfies the following expression:

$$m1\cdot L1+m2\cdot L2>2P1-(m1\cdot dp1+m2\cdot dp2)$$

where m1 represents an absolute value of the optical magnification of the first imaging optical system, L1 represents a width in the first direction of the first light emitting element group to be imaged by the first imaging optical system, dp1 represents a pitch between the light emitting elements in the first direction in the first light emitting element group to be imaged by the first imaging optical system, m2 represents an absolute value of the optical magnification of the second imaging optical system, L2 represents a width in the first direction of the second light emitting element group to be imaged by the second imaging optical system, and dp2 represents a pitch between the light emitting elements in the first direction in the second light emitting element group to be imaged by the second imaging optical system, and the first and the second imaging optical systems are structured such that m1 <1 and m2<1 are satisfied, where m1 and m2 are absolute values of the optical magnification of the first and the second imaging optical systems, respectively.

2. The exposure head of claim 1, comprising an array substrate which is light transmissive, wherein the first imaging optical system is provided with a curved surface upon which the light emitted from the first light emitting element group is incident, the second imaging optical system is provided with a curved surface upon which the light emitted from the second light emitting element group is incident, and the curved surface of the first imaging optical system and the curved surface of the second imaging optical system are arranged on the array substrate to form a lens array.

3. The exposure head of claim 2, wherein the first imaging optical system is provided with curved surfaces including a first curved surface and a second curved surface, the second imaging optical system is provided with curved surfaces including a third curved surface and a fourth curved surface, and the lens array constituted by the first curved surface and the third curved surface and the lens array constituted by the second curved surface and the fourth curved surface are different.

4. The exposure head of claim 2, wherein a base material of the array substrate is glass.

5. The exposure head of claim 2, comprising a light transmissive substrate which is provided with the curved surface, wherein the array substrate is provided with the light transmissive substrate.

6. The exposure head of claim 5, wherein the light transmissive substrate which is provided with the curved surface of the first imaging optical system and the light transmissive substrate which is provided with the curved surface of the second imaging optical system are different.

7. The exposure head of claim 1, comprising an element substrate which is provided with the light emitting element groups, wherein the element substrate which is provided with the first light emitting element group which is imaged by the first imaging optical system and the element substrate which is provided with the second light emitting element group which is imaged by the second imaging optical system are different.

8. The exposure head of claim 1, comprising imaging optical systems which include the first imaging optical system and the second imaging optical system, wherein N imaging optical system rows, in which the imaging optical system is arranged in the first direction, are arranged, where N is an integer equal to or larger than 3, the first imaging optical system belongs to the first imaging optical system row, and the second imaging optical system belongs to the N-th imaging optical system row.

9. The exposure head of claim 1, wherein the value m1·dp1 and the value m2·dp2 are equal.

10. The exposure head of claim 1, comprising an aperture diaphragm that is disposed between the first or second imaging optical system and the first or second light emitting element group which emits light which is imaged by the first or second imaging optical system.

11. The exposure head of claim 1, comprising a light shielding member that is disposed between the first or second imaging optical system and the first or second light emitting element group which emits light which is imaged by the first or second imaging optical system, and is provided with a light guiding hole through which the light from the first or second light emitting element group toward the first or second imaging optical system passes.

12. The exposure head of claim 1, wherein the first and the second imaging optical systems are structured to form an inverted image.

13. An image forming apparatus, comprising:

a latent image carrier; and an exposure head that forms a latent image on the latent image carrier, wherein the exposure head includes:

a first imaging optical system and a second imaging optical system which are arranged in a first direction;

a first light emitting element group including plural light emitting elements which emits light to be imaged by the first imaging optical system; and a second light emitting element group including plural light emitting elements which emits light to be imaged by the second imaging optical system, wherein an inter-optical-system distance P1 in the first direction between the first imaging optical system and the second imaging optical system satisfies the following expression:

$$m1 \cdot L1 + m2 \cdot L2 > 2P1 - (m1 \cdot dp1 + m2 \cdot dp2)$$

where m1 represents an absolute value of the optical magnification of the first imaging optical system, L1 represents a width in the first direction of the first light emitting element group to be imaged by the first imaging optical system, dp1 represents a pitch between the light emitting elements in the first direction in the first light emitting element group to be imaged by the first imaging optical system, m2 represents an absolute value of the optical magnification of the second imaging optical system, L2 represents a width in the first direction of the second light emitting element group to be imaged by the second imaging optical system, and dp2 represents a pitch between the light emitting elements in the first direction in the second light emitting element group to be imaged by the second imaging optical system, and the first and the second imaging optical systems are structured such that m1 <1 and m2<1 are satisfied, where m1 and m2 are absolute values of the optical magnification of the first and the second imaging optical systems, respectively.

14. An exposure head, comprising:

an i-th imaging optical system and an (i+1)-th imaging optical system which are arranged in a first direction, where i is a positive integer;

an i-th light emitting element group including plural light emitting elements which emit light to be imaged by the i-th imaging optical system; and an (i+1)-th light emitting element group including plural light emitting elements which emit light to be imaged by the (i+1)-th imaging optical system, wherein an inter-optical-system distance P1 in the first direction between the i-th imaging optical system and the (i+1)-th imaging optical system satisfies the following expression:

$$m(i)\cdot L(i)+m(i+1)\cdot L(i+1)>2P(i)-(m(i)\cdot dp(i)+m(i+1)\cdot dp(i+1))$$

where m(i) represents an absolute value of the optical magnification of the i-th imaging optical system, L(i) represents a width in the first direction of the i-th light emitting element group to be imaged by the i-th imaging optical system, dp(i) represents a pitch between the light emitting elements in the first direction in the i-th light emitting element group to be imaged by the i-th imaging optical system, m(i+1) represents an absolute value of the optical magnification of the (i+1)-th imaging optical system, L(i+1) represents a width in the first direction of the (i+1)-th light emitting element group to be imaged by the (i+1)-th imaging optical system, and dp(i+1) represents a pitch between the light emitting elements in the first direction in the (i+1)-th light emitting element group to be imaged by the (i+1)-th imaging optical system, and the i-th and the (i+1)-th imaging optical systems are structured such that m(i)<1 and m(i+1)<1 are satisfied, where m(i) and m(i+1) are absolute values of the optical magnification of the i-th and the (i+1)-th imaging optical systems, respectively.

* * * * *